US012559927B2

(12) United States Patent
Yao

(10) Patent No.: US 12,559,927 B2
(45) Date of Patent: Feb. 24, 2026

(54) SEAT WATERWAY SYSTEM, SEAT STRUCTURE, TOILET, WATERWAY DIVERTING STRUCTURE, AND SEAT MECHANISM

(71) Applicant: KOHLER (CHINA) INVESTMENT CO., LTD., Shanghai (CN)

(72) Inventor: Pingsheng Yao, Shanghai (CN)

(73) Assignee: KOHLER (CHINA) INVESTMENTCO., LTD., Shanghai (CN)

( * ) Notice: Subject to any disclaimer, the term of this patent is extended or adjusted under 35 U.S.C. 154(b) by 128 days.

(21) Appl. No.: 18/646,150

(22) Filed: Apr. 25, 2024

(65) Prior Publication Data

US 2024/0360655 A1 Oct. 31, 2024

(30) Foreign Application Priority Data

Apr. 28, 2023 (CN) ..... 202321033004.0
Apr. 28, 2023 (CN) ..... 202321033064.2

(51) Int. Cl.
*E03D 9/08* (2006.01)
*E03D 1/30* (2006.01)
*E03D 1/36* (2006.01)

(52) U.S. Cl.
CPC ..... *E03D 9/08* (2013.01); *E03D 1/308* (2013.01); *E03D 1/36* (2013.01)

(58) Field of Classification Search
CPC .. E03D 9/08; E03D 1/308; E03D 1/36; E03D 1/306; A47K 13/24; F16K 19/00; F16K 24/04
USPC ..... 4/300, 408, 409, 246.1, 246.2, 250, 4/443–448
See application file for complete search history.

(56) References Cited

U.S. PATENT DOCUMENTS

2018/0305914 A1* 10/2018 Wang ..... E03D 9/08
2024/0044121 A1* 2/2024 Yao ..... E03D 9/08

FOREIGN PATENT DOCUMENTS

CN 213721694 U 7/2021
CN 115736690 A 3/2023

* cited by examiner

*Primary Examiner* — Tuan N Nguyen
(74) *Attorney, Agent, or Firm* — Lempia Summerfield Katz LLC

(57) ABSTRACT

A seat waterway system includes a control mechanism configured to be disposed at one side of a seat, and the control mechanism includes a spray pipe switching valve. The seat waterway system also includes a waterway diverting valve. The waterway diverting valve includes a diverting valve housing configured to be disposed in a rear base of the seat. The waterway diverting valve also includes a rotating valve core pivotably connected to the diverting valve housing and configured to be rotated with the seat, the rotating valve core comprising one end disposed in the diverting valve housing. The waterway diverting valve also includes a diverting valve inlet end configured to be connected to one end of the diverting valve housing.

20 Claims, 21 Drawing Sheets

A-A

B-B

SEAT WATERWAY SYSTEM, SEAT STRUCTURE, TOILET, WATERWAY DIVERTING STRUCTURE, AND SEAT MECHANISM

CROSS REFERENCE TO RELATED APPLICATION

This application claims the benefit of priority to: Chinese Patent Application No. 202321033004.0 filed in the Chinese Intellectual Property Office on Apr. 28, 2023, which is hereby incorporated by reference in its entirety; and Chinese Patent Application No. 202321033064.2 filed in the Chinese Intellectual Property Office on Apr. 28, 2023, which is hereby incorporated by reference in its entirety.

FIELD

The present disclosure relates to the field of sanitary products, and in particularly to a seat waterway system, a seat structure and a toilet. The present disclosure relates to the field of toilet waterway diverting parts, in particularly relates to a waterway diverting structure and a seat mechanism.

BACKGROUND

The seat is a component of the toilet. Some of the existing seats are integrated to provide a flushing function. For example, a spray pipe is configured in the seat for flushing the private part of a user. Therefore, it is necessary to configure a waterway and a switching control mechanism in the seat, accordingly.

The Chinese utility model patent with the publication number of CN213721694U discloses an integrated cover plate assembly comprising a cover plate and a seat, wherein the seat is also integrated with an outlet assembly, a control assembly, and a waterway in communication with the outlet assembly and the control assembly. The control assembly is embedded in a rear side portion of the seat, and the control assembly centrally controls the selection of the waterway, the flow rate, and the on-off of the waterway; the control assembly comprises a valve body, a valve stem, a rotating base, a knob and so on, and the valve body has one inlet and two outlets. The rear side portion of the seat is also provided with one inlet joint comprising one inlet pipe and one outlet pipe, wherein the inlet pipe is externally connected to a water supply source, and the outlet pipe is inserted into an inlet of the valve body.

However, in the above-mentioned patent, the inlet joint is provided in a rear side portion of the seat, when the seat rotates, the inlet joint will move along with the seat, which drives the water pipe connected with the water source to move together. In the process of movement, the water pipe connected with the water source is stretched and bent. The water pipe is prone to be damaged and causes leakage, it is also prone to displace from the inlet joint and cause leakage.

As people's living standard of living level ameliorates, there are more requirements for the functionality of a toilet in sanitary products. The waterway arrangement in a cover plate assembly of a toilet directly affects the size of the cover plate assembly and the ease of use.

The Chinese invention patent with the publication number of CN115736690A discloses a flushing cover plate, wherein a flushing assembly is integrated inside the seat, a waterway transfer joint is provided in the middle of the seat and connected with an external tap water joint. An outlet end of the waterway diverting joint is connected with a shunt valve mounted at a bottom of the seat, and the shunt valve is then connected with the flushing assembly through a pipeline.

As can be seen, the waterway diverting joint in the above patent is only used for connecting the shunt valve to the external tap water joint, and it does not have the function of diverting the water from the shunt valve to the flushing assembly, which results in the need to mount a long water pipe in the mounting cavity at a rear portion of the seat to connect the shunt valve with the flushing assembly. Such a pipeline structure is not highly integrated, the long pipe takes up some of the mounting space of the mounting cavity and needs to be further specially fixed and has complex structures.

SUMMARY

The object of the present disclosure is to remove the disadvantages in the prior art, and provide a seat waterway system, a seat structure and a toilet, wherein the waterway diverting valve is fixedly mounted in a rear base at a rear end of the seat, an inlet joint is kept fixed, a water pipe connected between a water source and an inlet joint no longer needs to move along with the seat. Such a stable structure reduces the possibility of leakage. The control mechanism is at one side of the seat, a rotating valve core is capable of rotating with the seat as a whole, so that the water pipe connected between the rotating valve core and the control mechanism is capable of moving with the seat as a whole, facilitating the waterway arrangement in the seat.

A technical solution of the present disclosure provides a seat waterway system, comprising a control mechanism for being mounted at one side of a seat, and a waterway diverting valve for being mounted in a rear base of the seat;

the control mechanism comprises a spray pipe switching valve;

the waterway diverting valve comprises a diverting valve housing for being fixedly mounted in the rear base, a rotating valve core pivotably connected with the diverting valve housing and capable of rotating with the seat as a whole, and a diverting valve inlet end connected to one end of the diverting valve housing;

the diverting valve inlet end has an inlet joint;

the rotating valve core comprises a water supply channel, one end of the rotating valve core is assembled in the diverting valve housing, an inlet of the water supply channel is in communication with the inlet joint, and an outlet of the water supply channel is in communication with a switching valve inlet of the spray pipe switching valve.

In an embodiment, the diverting valve housing is provided with a spray pipe joint;

the rotating valve core has a water returning channel, and an inlet of the water returning channel is in communication with the switching valve outlet of the spray pipe switching valve;

an outer peripheral surface of the rotating valve core has a water guiding groove in communication with the water returning channel, and the spray pipe joint is in communication with the water guiding groove.

In an embodiment, the water guiding groove is in an arcuate or annular shape.

In an embodiment, the diverting valve housing is provided with two spray pipe joints, and two water guiding grooves are provided on an outer peripheral surface of the rotating valve core at an interval, the two water guiding grooves is in communication with the two spray pipe joints, respectively;

the rotating valve core has two water returning channels, the two returning channels is in communication with the two water guiding grooves, respectively;

the spray pipe switching valve has two switching valve outlets, the two switching valve outlets is in communication with the inlets of the two water returning channels, respectively.

In an embodiment, an inlet of the water returning channel and an outlet of the water supply channel are at the same end of the rotating valve core;

an outlet of the water supply channel is connected with a water supply joint, and an inlet of the water returning channel is connected with a water returning joint;

In an embodiment, the seat waterway system comprises a chuck for being clamped with a pivot sleeve of the seat, a circumferential surface of the chuck is provided with a plurality of slots at intervals, the water supply joint and the water returning joint are clamped in the slots, respectively.

In an embodiment, the inlet joint comprises a cold water inlet joint and/or a hot water inlet joint, and the water supply channel is configured as a cold water supply channel and/or a hot water supply channel;

the cold water supply channel is in communication with the cold water inlet joint, and the hot water supply channel is in communication with the hot water inlet joint;

the control mechanism also comprises a mixing valve, an outlet of the cold water supply channel is in communication with a cold water inlet of the mixing valve, and an outlet of the hot water supply channel is in communication with a hot water inlet of the mixing valve;

a warm water outlet of the mixing valve is in communication with the switching valve inlet.

In an embodiment, the inlet joint further comprises a temperature control valve, the hot water inlet joint is in communication with a hot water outlet of the temperature control valve.

In an embodiment, the diverting valve inlet end comprises a fixing sleeve and an end cap connected with the fixing sleeve;

the cold water inlet joint and the hot water inlet joint are connected with the end cap, respectively;

a rotating sleeve is mounted in the fixing sleeve, and a partition is provided in the rotating sleeve;

a first sealing piece and a second sealing piece attached to the first sealing piece are sequentially assembled between the end cap and the rotating sleeve;

the first sealing piece has two first sealing piece through holes in communication with the cold water inlet joint and the hot water inlet joint, respectively;

the second sealing piece has two second sealing piece through holes in communication with two first sealing piece through holes, respectively, and the second sealing piece through holes is in an arcuate shape;

an inlet end of the cold water supply channel and an inlet end of the hot water supply channel pass through the partition, respectively, and in communication with two second sealing piece through holes, respectively.

In an embodiment, the first sealing piece and the second sealing piece are ceramic sealing pieces, respectively.

In an embodiment, a first spacer is assembled between the end cap and the first sealing piece, the first spacer has two first spacer through holes in communication with two first sealing piece through holes, respectively; and a second spacer is assembled between the partition and the second sealing piece, the second spacer has two second spacer through holes in communication with two second sealing piece through holes, accordingly.

In an embodiment, an inlet end of the cold water supply channel is connected to a cold water inlet end plug joint and an inlet end of the hot water supply channel is connected to a hot water inlet end plug joint;

the partition is provided with two partition through holes for the cold water inlet end plug joint and the hot water inlet end plug joint to pass through;

the cold water inlet end plug joint and the hot water inlet end plug joint pass through two partition through holes and being inserted into the two second spacer through holes, respectively.

In an embodiment, the diverting valve housing is connected with a fixing base (e.g., a connecting base) for being connected with the rear base of the seat.

A technical solution of the present disclosure also provides a seat structure, comprising a seat, a rear base connected to a rear end of the seat, a flushing spray pipe assembled in the seat and/or the rear base and capable of being extended and retracted, and a seat waterway system according to any one of the preceding technical solutions.

a rear end of the seat is connected to with pivot sleeve, the pivot sleeve is pivotably connected with the rear base;

the control mechanism is mounted at one side of the seat;

the waterway diverting valve is mounted in the rear base, the rotating valve core is coaxially arranged with the pivot sleeve and capable of rotating with it as a whole;

the switching valve outlet of the spray pipe switching valve is in communication with the flushing spray pipe.

In an embodiment, the spray pipe switching valve comprises a mechanical handle, the mechanical handle extends outwardly to an outer side of the seat.

In an embodiment, the diverting valve housing is provided with a spray pipe joint;

the rotating valve core has a water returning channel, an inlet of the water returning channel is in communication with the switching valve outlet;

an outer peripheral surface of the rotating valve core has a water guiding groove in communication with the water returning channel, and the spray pipe joint is in communication with the water guiding groove;

the spray pipe joint is in communication with the flushing spray pipe.

In an embodiment, an inlet of the water returning channel and an outlet of the water supply channel are at the same end of the rotating valve core;

an outlet of the water supply channel is connected with a water supply joint, and an inlet of the water returning channel is connected with a water returning joint;

the seat waterway system comprises a chuck, a circumferential surface of the chuck is provided with a plurality of slots at intervals, and the water supply joint and the water returning joint are clamped in the slots, respectively;

the chuck is clamped with the pivot sleeve.

In an embodiment, one side of the seat has a seat extension portion, the control mechanism is mounted in the seat extension portion.

In an embodiment, the control mechanism comprises a trim plate, and the spray pipe switching valve is connected with the trim plate;

an outer surface of the seat extension portion has an extension recess, and the trim plate is assembled in the extension recess.

A technical solution of the present disclosure also provides a toilet comprising a seat structure according to any one of the preceding technical solutions.

By adopting the preceding technical solutions, the present disclosure has the following beneficial effects:

The seat waterway system, the seat structure and the toilet provided by present disclosure comprises a control mechanism and a waterway diverting valve, wherein the waterway diverting valve is fixedly mounted in a rear base of a rear end of the seat, an inlet joint is kept fixed, a water pipe connected between a water source and an inlet joint no longer needs to move with the seat. Such a stable structure reduces the possibility of leakage. The control mechanism is at one side of the seat, a rotating valve core of the waterway diverting valve is capable of rotating with the seat as a whole, so that the water pipe connected between the rotating valve core and the control mechanism is capable of moving with the seat as a whole, facilitating the waterway arrangement in the seat.

The present disclosure aims to remove the disadvantages in the prior and provide a waterway diverting structure and a seat mechanism, which may divert a waterway to a control valve (e.g., a spray pipe switching valve) of the seat as well as divert the water outputted from the control valve to the flushing assembly of the seat, which can optimize the water pipe arrangement in the seat, shorten the water pipe length in the seat, and save the mounting space. The rotating valve core of the waterway diverting structure can rotate with the seat as a whole, so that the control valve can be mounted at one side of the seat for an ease use of a user.

A technical solution of the present disclosure provides a waterway diverting structure, comprising a diverting valve housing with a flushing joint (e.g., a spray pipe joint), a rotating valve core with an outlet joint (e.g., a water supply joint) and a water returning joint, and an inlet end (e.g., a diverting valve inlet end) with an inlet joint; wherein the diverting valve inlet end is fixedly mounted at one end of the diverting valve housing, the rotating valve core is at least partially pivotably assembled in the diverting valve housing, one end of the rotating valve core away from the diverting valve inlet end is connected with the water supply joint and the water returning joint;

the rotating valve core has an outlet channel (e.g., water supply channel) in communication with the inlet joint and the water supply joint;

the rotating valve core also has a water returning channel in communication with the water returning joint, an outer peripheral surface of the rotating valve core is provided with a diverting groove (e.g., a water guiding groove) in communication with the water returning channel, and the spray pipe joint is in communication with the water guiding groove.

In an embodiment, the water guiding groove on an outer peripheral surface of the rotating valve core is in an arcuate or circular shape.

In an embodiment, a seal ring is assembled between the two sides of the water guiding groove and the diverting valve housing.

In an embodiment, the inlet joint comprises a cold water inlet joint and/or a hot water inlet joint;

the water supply channel comprises a cold water outlet channel (e.g., a cold water supply channel) and/or a hot water outlet channel (e.g., a hot water supply channel), the cold water supply channel is in communication with the cold water inlet joint, and the hot water supply channel is in communication with the hot water inlet joint;

the water supply joint comprises a cold water outlet joint and/or a hot water outlet joint, the cold water outlet joint is in communication with the cold water supply channel, and the hot water outlet joint is in communication with the hot water supply channel.

In an embodiment, the inlet joint comprises a rotating sleeve with a partition;

a first sealing piece and a second sealing piece attached to the first sealing piece are sequentially assembled between the outlets of the cold water inlet joint and the hot water inlet joint and the rotating sleeve;

the first sealing piece has two first sealing piece through holes in communication with the outlets of the cold water inlet joint and the hot water inlet joint, respectively;

the second sealing piece has two second sealing piece through holes in communication with the two first sealing piece through holes, respectively, and the second sealing piece through holes are in an arcuate shape;

an inlet end of the cold water outlet channel and an inlet end of the hot water outlet channel pass through the partition, respectively, and in communication with the two second sealing piece through holes, respectively.

In an embodiment, the first sealing piece and the second sealing piece are ceramic sealing pieces, respectively.

In an embodiment, a first spacer is assembled between the outlets of the cold water inlet joint and the hot water inlet joint and the first sealing piece, the first spacer has two first spacer through holes in communication with the two first sealing piece through holes, respectively;

a second spacer is assembled between the partition and the second sealing piece, and the second spacer has two second spacer through holes in communication with the two second sealing piece through holes, respectively.

In an embodiment, the spray pipe joint comprises a first flushing joint and a second flushing joint arranged at an interval;

the water returning channel comprises a first water returning channel and a second water returning channel which are independent from each other, the water returning joint comprises a first water returning joint being in communication with the first water returning channel, and a second water returning joint being in communication with the second water returning channel;

the water guiding groove comprises a first diverting groove and a second diverting groove arranged at an interval, the first diverting groove is in communication with the first water returning channel, and the first flushing joint is in communication with the first diverting groove;

the second diverting groove is in communication with the second water returning channel, and the second flushing joint is in communication with the second diverting groove.

In an embodiment, the waterway diverting structure comprises a chuck for being assembled with a connecting sleeve (e.g., a pivot sleeve) of a seat, and more than two slots are provided on the chuck at intervals;

the water supply joint and the water returning joint are clamped in the slots, respectively.

In an embodiment, the waterway diverting structure comprises a connecting base for being connected with a mounting base of a seat, and the connecting base is connected with the diverting valve housing.

A technical solution of the present disclosure also provides a seat mechanism, comprising a seat and a waterway diverting structure according to any one of the preceding technical solutions;

the diverting valve housing is connected with the seat;

a rear end of the seat has a connecting sleeve (e.g., a pivot sleeve), wherein the rotating valve core is arranged coaxially with the pivot sleeve, and the rotating valve core rotates with the seat as a whole.

By adopting the above technical solutions, the present disclosure has the following beneficial effects:

the waterway diverting structure provided by present disclosure comprises a diverting valve housing, a rotating valve core and an diverting valve inlet end, wherein the diverting valve housing is fixed in a mounting cavity at a rear end of the seat, the rotating valve core is pivotably connected with the diverting valve housing, the rotating valve core is also capable of rotating with the seat as a whole, the inlet channel of the rotating valve core is in communication with the inlet joint of the diverting valve inlet end, the water supply joint of the rotating valve core is used for connecting with the inlet of the spray pipe switching valve of the seat, the water returning joint of the rotating valve core is used for connecting with the outlet of the control valve, the spray pipe joint of the diverting valve housing is used for connecting with the flushing assembly of the seat, and the spray pipe joint is in communication with a water guiding groove of the rotating valve core.

Water can enter the control valve via the inlet joint, the inlet channel, and the water supply joint, and water out of the control valve enters the flushing assembly via the water returning joint, the water returning channel, the water guiding groove, and the spray pipe joint.

As can be seen, the present disclosure provides a waterway diverting structure and a seat mechanism, which may divert a waterway to the control valve of the seat, as well as divert the water outputted from the control valve to the flushing assembly of the seat, which can optimize the water pipe arrangement in seat, shorten the water pipe length in the seat, and save the mounting space.

In the waterway diverting structure and the seat mechanism provided by the present disclosure, the rotating valve core can be rotated with the seat as a whole, When the seat is rotating, the control valve, the rotating valve core, the water supply joint, the water returning joint and the water pipe connected between the water supply joint, the water returning joint and the control valve are simultaneously driven to rotate together as a whole, so that the control valve can be mounted at one side of the seat for an ease use of a user.

BRIEF DESCRIPTION OF THE FIGURES

With reference to the drawings, the contents disclosed by the present disclosure will be more easily understood. It should be understood that: these drawings are merely used for illustration, and are not intended to limit the protection scope of the present disclosure. In the drawings.

DETAILED DESCRIPTION

Embodiment 1

Figure 1:
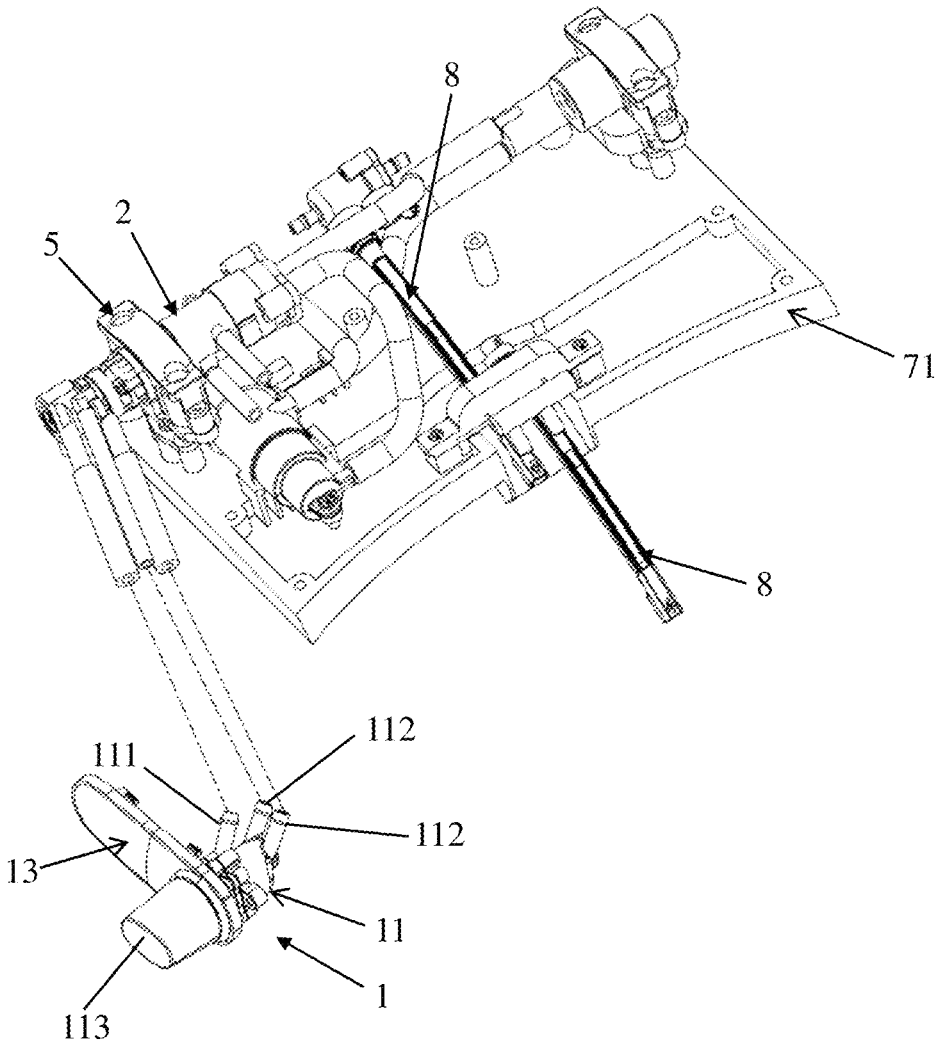
FIG. 1 is a schematic diagram of a seat waterway system provided by an embodiment of the present disclosure.

The specific embodiments of the present disclosure are further described with reference to the drawings hereinafter. Same or equivalent parts are denoted by the same reference numerals. It should be noted that, the terms of "front", "rear", "left", "right", "up" and "down" used in the following description refer to the directions in the drawings, and the terms of "inner" and "outer" refer to the directions toward or away from the geometric centers of specific parts, respectively.

As shown in FIGS. 1 and 3-9 and in combination with FIGS. 13-16, a seat waterway system provided by an embodiment of the present disclosure comprises a control mechanism 1 for being mounted at one side of a seat 6, and a waterway diverting valve 2 for being mounted in a rear base 7 of the seat 6.

The control mechanism 1 comprises a spray pipe switching valve 11.

The waterway diverting valve 2 comprises a diverting valve housing 21 for being fixedly mounted in the rear base 7, a rotating valve core 22 pivotably connected with the diverting valve housing 21 and capable of rotating with the seat 6 as a whole, and a diverting valve inlet end 23 connected to one end of the diverting valve housing 21.

The diverting valve inlet end 23 has inlet joints 233.

The rotating valve core 22 comprises the water supply channels 221, one end of the rotating valve core 22 is assembled in the diverting valve housing 21, wherein the inlets of the water supply channels 221 are in communication with the inlet joints 233, and the outlets of the water supply channels 221 are in communication with the switching valve inlets 111 of the spray pipe switching valve 11.

The seat waterway system provided by the present disclosure is used for being assembled in the seat 6 shown in FIGS. 13-16 and the rear base 7 of the rear portion thereof, so as to supply water to the flushing spray pipes 8, as well as to control the on-off of the flushing spray pipes 8 or the switching of the waterway.

The communication involved in the present disclosure can be a direct communication between two components, or a water pipe can be used to realize the communication for the waterway. The term of a "pivotable connection" involved in this present disclosure means that two components can be rotated relative to each other.

The seat waterway system comprises a control mechanism 1 and a waterway diverting valve 2. The control mechanism 1 is used to be mounted at one side of the seat 6 for a user to operate and control. The control mechanism 1 comprises a spray pipe switching valve 11 for controlling the on-off of the flushing spray pipe 8 or the switching of the waterways. The waterway diverting valve 2 is fixedly mounted in the rear base 7.

The waterway diverting valve 2 comprises a diverting valve housing 21, a rotating valve core 22 and a diverting valve inlet end 23.

The diverting valve housing 21 is fixedly mounted in the rear base 7. Specifically, the diverting valve housing 21 is fixed to a rear base bottom plate 71 of the rear base 7. The rotating valve core 22 is connected in the diverting valve housing 21, and the rotating valve core 22 is rotatable in the diverting valve housing 21 and pivotably connected with the diverting valve housing 21. As needed, one end of the rotating valve core 22 may extend out of the diverting valve housing 21, so as to be assembled with the control mechanism 1.

The rear end of the seat 6 has is a pivot sleeve 63 which is pivotably connected with the rear base 7. The seat 6 rotates around the centerline of the pivot sleeves 63, so as to swing upwardly and downwardly. While assembling, the rotating valve core 22 is coaxially configured with the pivot sleeve 63 and capable of rotating with the seat 6 as a whole. The rotating valve core 22 can be connected with the pivot sleeve 63. The two can be directly connected or connected through a connection mechanism. While rotating, the seat 6 drives the pivot sleeve 63 to rotate. In turn, the rotating valve core 22 is driven to rotate with them as a whole. The rotating valve core 22 comprises water supply channels 221 for supplying water to the spray pipe switching valve 11.

The diverting valve inlet end 23 is connected to one end of the diverting valve housing 21. The diverting valve inlet end 23 has inlet joints 233 which are used for connecting with an upstream water source or a water supply mechanism. As needed, the inlet joints 233 can be connected so as to provide only cold water, only hot water, or only pre-adjusted warm water. The cold water may be any liquid, including water, having a temperature lower than a first predetermined temperature. The hot water may be any liquid, including water, having a temperature higher than a second predetermined temperature. The warm water may be any liquid, including water, having a temperature between the first predetermined temperature and the second predetermined temperature. The second predetermined temperature is higher than the first predetermined temperature.

The inlets of the water supply channels 221 are connected with the inlet joints 233. Specifically, an inlet of a water supply channel 221 may be pivotably connected with an outlet of an inlet joint 233, wherein a seal ring is used for sealing between them; or the inlet end plug joints 224 may be configured in the inlet ends of the water supply channels 221, and the inlet end plug joints 224 are sleeved with the inlet joints 233, wherein a seal ring is used for sealing between the two; or a water cavity may be configured in a diverting valve inlet end 23, wherein the inlets of the water supply channels 221 and the outlets of the inlet joints 233 are in communication with the water cavity, respectively. While the rotating valve core 22 is rotating, the water supply channels 221 rotate, but the inlets of the water supply channels 221 are kept in communication with the outlets of the inlet joints 233, so as to keep the waterway unblocked.

An outlet of the water supply channel 221 is in communication with a switching valve inlet 111 of the spray pipe switching valve 11. Specifically, an outlet of a water supply channel 221 is connected with a switching valve inlet 111 via a water pipe, and this section of the water pipe rotates with the seat 6 as a whole. A switching valve outlet 112 is in communication with a flushing spray pipe 8. Specifically, a switching valve outlet 112 is connected with a flushing spray pipe 8 via a water pipe. The user may operate the spray pipe switching valve 11 to control the on-off of the flushing spray pipes 8 or the switching of the waterways. The spray pipe switching valve 11 may be a touch control valve with a touch panel, or a mechanical valve with a mechanical handle 113. The touch panel and the mechanical handle 113 are mounted at one side of the seat 6 to facilitate the operation of the user.

Hereby, in the seat waterway system provided by present disclosure, the waterway diverting valve 2 is fixedly mounted in a rear base 7 of a rear end of the seat 6, an inlet joint 233 is kept fixed, a water pipe connected between a water source and an inlet joint 233 no longer needs to move along with the seat 6. Such a stable structure reduces the possibility of leakage. The control mechanism 1 is at one side of the seat 6, and the rotating valve core 22 of the waterway diverting valve 2 is capable of rotating with the seat 6 as a whole, so that the water pipe connected between the rotating valve core 22 and the control mechanism 1 is capable of moving with the seat 6 as a whole, facilitating the waterway arrangement in the seat 6.

In an embodiment, as shown in FIGS. 3-9, the diverting valve housing 21 is provided with spray pipe joints 211.

The rotating valve core 22 has water returning channels 222. An inlet of a water returning channel 222 is in communication with a switching valve outlet 112 of the spray pipe switching valve 11.

An outer peripheral surface of the rotating valve core 22 has water guiding grooves 223 in communication with the water returning channels 222, and the spray pipe joints 211 are in communication with the water guiding grooves 223.

In this embodiment, the diverting valve housing 21 is configured with spray pipe joints 211 for connecting with the flushing spray pipes 8 through water pipes, so as to supply water to the flushing spray pipes 8.

The rotating valve core 22 is configured with water returning channels 222. An inlet of a water returning channel 222 is at an end toward the control mechanism 1, and the other end of the water returning channel 222 is enclosed. An inlet of a water returning channel 222 is connected with a switching valve outlet 112 through a water pipe.

An outer peripheral surface of the rotating valve core 22 is provided with water guiding grooves 223 which extend in a circumferential direction on the outer peripheral surface of the rotating valve core 22. A groove bottom of a water guiding groove 223 is in communication with a water returning channel 222 via a through hole. Waterways are formed between the water guiding grooves 223 and the diverting valve housing 21. While the rotating valve core 22 is rotating, the spray pipe joints 211 do not move, but the inlets of the spray pipe joints 211 always stay between the two ends of a water guiding groove 223. The inlets of the spray pipe joints 211 are kept in communication with the water guiding grooves 223, so as to supply water to the spray pipe joints 211.

With such an arrangement, there is no need to directly connect an inlet of a spray pipe joint 211 and a switching valve outlet 112 through a water pipe. Thus, the length of the water pipe between the inlet of the spray pipe joint 211 and the switching valve outlet 112 is reduced. A fastener for fixing a long water pipe is no longer needed. Flushing water is delivered through the water returning channels 222 of the rotating valve core 22. Such an arrangement is highly integrated and provides a stable connection.

As needed, a seal ring may be assembled between both sides of the water guiding channels 223 and the diverting valve housing 21 to enhance the sealing performance of the water guiding channels 223.

In an embodiment, the water guiding grooves 223 are in an arcuate or annular shape on the outer peripheral surface of the rotating valve core 22. The arcuate or annular water guiding grooves 223 are coaxially arranged with the rotating valve core 22. While rotating, the rotating valve core 22 makes the arcuate or annular water guiding grooves 223 to rotate with them as a whole, and the rotating water guiding grooves 223 may be kept in communication with the fixed spray pipe joints 211.

In an embodiment, as shown in FIGS. 3-9, the diverting valve housing 21 is provided with two spray pipe joints 211, and two water guiding grooves 223 are provided on an outer peripheral surface of the rotating valve core 22 at an interval, wherein the two water guiding grooves 223 are in communication with the two spray pipe joints 211, respectively.

The rotating valve core 22 has two water returning channels 222 which are in communication with the two water guiding grooves 223, respectively.

The spray pipe switching valve 11 has two switching valve outlets 112 which are in communication with the inlets of the two water returning channels 222, respectively.

In this embodiment, if the seat 6 and/or the rear base 7 are configured with two flushing spray pipes 8, one flushing spray pipe 8 is used for forward flushing and the other flushing spray pipe 8 is used for backward flushing, then accordingly, the diverting valve housing 21 is provided with two spray pipe joints 211, and the spray pipe switching valve 11 is configured with two switching valve outlets 112. The rotating valve core 22 has two water returning channels 222, and the outer peripheral surface of the rotating valve core 22 is provided with two water guiding grooves 223 at an interval.

The two switching valve outlets 112, the two water returning channels 222, the two water guiding channels 223 and the two spray pipe joints 211 form two flow paths to supply water to the two flushing spray pipes 8.

The spray pipe switching valve 11 can control the on-off of the two switching valve outlets 112, so as to control the availability of the waterway of the flushing spray pipes 8, which in turn controls the flushing spray pipes 8 to spray water or stop spraying water.

In an embodiment, as shown in FIGS. 3-6, an inlet of a water returning channel 222 and an outlet of a water supply channel 221 are at the same end of the rotating valve core 22.

An outlet of a water supply channel 221 is connected with a water supply joint 225, and an inlet of a water returning channel 222 is connected with a water returning joint 226.

In this embodiment, the inlets of the water returning channels 222 and the outlets of the water supply channels 221 are configured at one end of the rotating valve core 22 proximate to the control mechanism 1. Accordingly, the water supply joints 225 and the water returning joints 226 are configured, so as to connect the switching valve inlets 111 with the water supply joints 225 through the water pipes. This also facilitates connecting the switching valve outlets 112 with the water returning joints 226 through the water pipes. The water supply joints 225 and the water returning joints 226 are rigid plastic pipes which can pass through the pivot sleeve 63. As needed, they can be configured as an L-shape to facilitate the communication between the water supply channels 221 and the spray pipe switching valve 11, and the communication between the spray pipe switching valve 11 and the water returning channels 222.

In an embodiment, as shown in FIGS. 3-6, the seat waterway system comprises a chuck 4 for being clamped with a pivot sleeve 63 of the seat 6, wherein a circumferential surface of the chuck 4 is provided with a plurality of the slots 41 at intervals, and the water supply joints 225 and the water returning joints 226 are clamped in the slots 41, respectively.

In this embodiment, one end of the rotating valve core 22 is configured with the chuck 4, which may be connected with the rotating valve core 22, or may be arranged at an interval from the rotating valve core 22. The chuck 4 is used for being clamped with a pivot sleeve 63. Thus, the chuck 4 can be rotated with the seat 6 as a whole. The chuck 4 is provided with more than two slots 41 along the circumferential direction. The water supply joints 225 and the water returning joints 226 are clamped in the slots 41, respectively. While rotating, the chuck 4 drives the water supply joints 225 and the water returning joints 226 to rotate with it as a whole, which in turn drives the rotating valve core 22 to rotate with them as a whole. Thus, the arrangements of the water pipes connected between the spray pipe switching valve 11 and the water supply joints 225 and the water pipes connected between the spray pipe switching valve 11 and the water returning joints 226 will not be affected.

In an embodiment, as shown in FIGS. 2-9, the inlet joints 233 comprise a cold water inlet joint 2331 and/or a hot water inlet joint 2332, and the water supply channels 221 comprise a cold water supply channel 2211 and/or a hot water supply channel 2212.

The cold water supply channel 2211 is in communication with the cold water inlet joint 2331, and the hot water supply channel 2212 is in communication with the hot water inlet joint 2332.

The control mechanism 1 also comprises a mixing valve 12, wherein an outlet of the cold water supply channel 2211 is in communication with a cold water inlet of the mixing valve 12, and an outlet of the hot water supply channel 2212 is in communication with a hot water inlet of the mixing valve 12.

A warm water outlet of the mixing valve 12 is in communication with a switching valve inlet 111.

In this embodiment, the inlet joints 233 comprise a cold water inlet joint 2331 connected with a tap water pipeline and/or a hot water inlet joint 2332 connected with a hot water pipeline, so as to supply cold and hot water to the rotating valve core 22. The cold and hot water is then adjusted as warm water via the mixing valve 12, to supply warm water to the flushing spray pipes 8.

The water supply channels 221 of the rotating valve core 22 are configured as a cold water supply channel 2211 and/or a hot water supply channel 2212, respectively, with the inlet end of the cold water supply channel 2211 remaining in communication with the cold water inlet joint 2331, and the inlet end of the hot water supply channel 2212 remaining in communication with the hot water inlet joint 2332.

In order to meet the water temperature requirements for different users, the control mechanism 1 is configured with a mixing valve 12 for mixing the cold and hot water into warm water. The mixing valve 12 has a cold water inlet, a hot water inlet and a warm water outlet. The outlet of the cold water supply channel 2211 is connected with the cold water inlet of the mixing valve 12 through a water pipe, the outlet of the hot water supply channel 2212 is connected with the hot water inlet of the mixing valve 12 through a water pipe, and the warm water outlet of the mixing valve 12 is connected with one switching valve inlet 111 through a water pipe.

Figure 2:
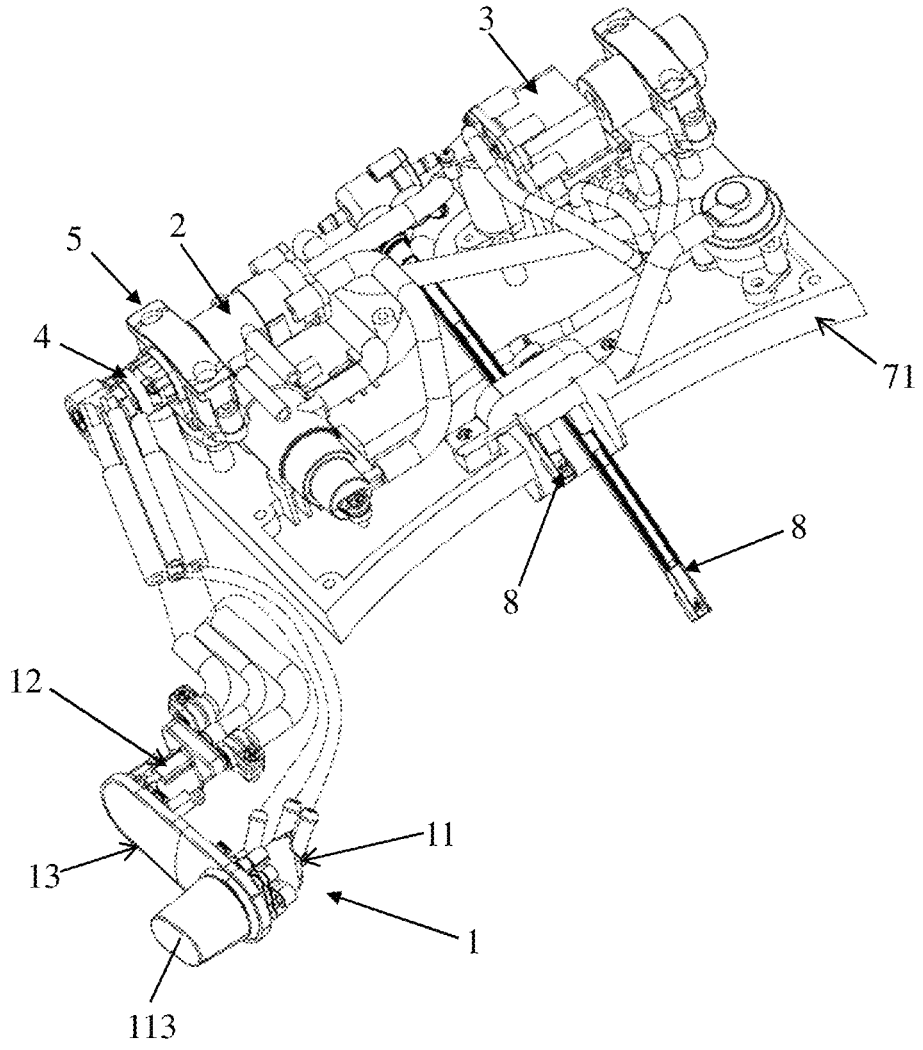
FIG. 2 is a schematic diagram of a seat waterway system provided by another embodiment of the present disclosure.

In an embodiment, as shown in FIG. 2, the seat waterway system further comprises a temperature control valve 3, and the hot water inlet joint 2332 is in communication with a hot water outlet of the temperature control valve 3.

In this embodiment, the seat waterway system is configured with the temperature control valve 3 which is used to adjust the cold and hot water to a preset temperature, such that the upstream water temperature can be controlled to prevent the temperature of the hot water entering the mixing valve 12 from being too high. The temperature control valve 3 is an element available in the prior art. Thus, its working principle will not be repeated here.

The cold water inlet of the temperature control valve 3 is connected with a tap water pipeline, the hot water inlet of the temperature control valve 3 is connected with a hot water pipeline, and the hot water outlet of the temperature control valve 3 is connected with the hot water inlet joint 2332 through a water pipe.

Figure 11:
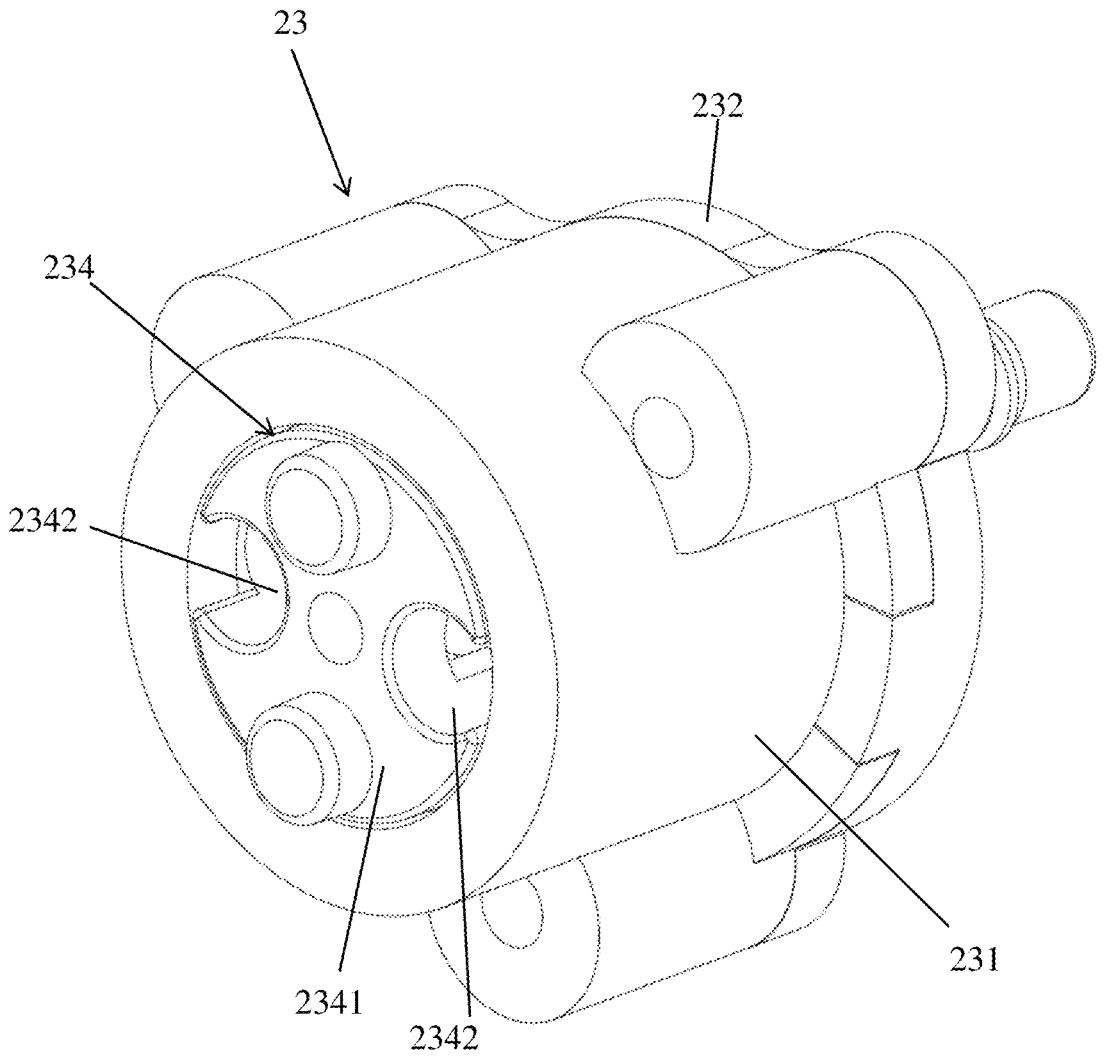
FIG. 11 is a perspective view of a diverting valve inlet end.
Figure 12:
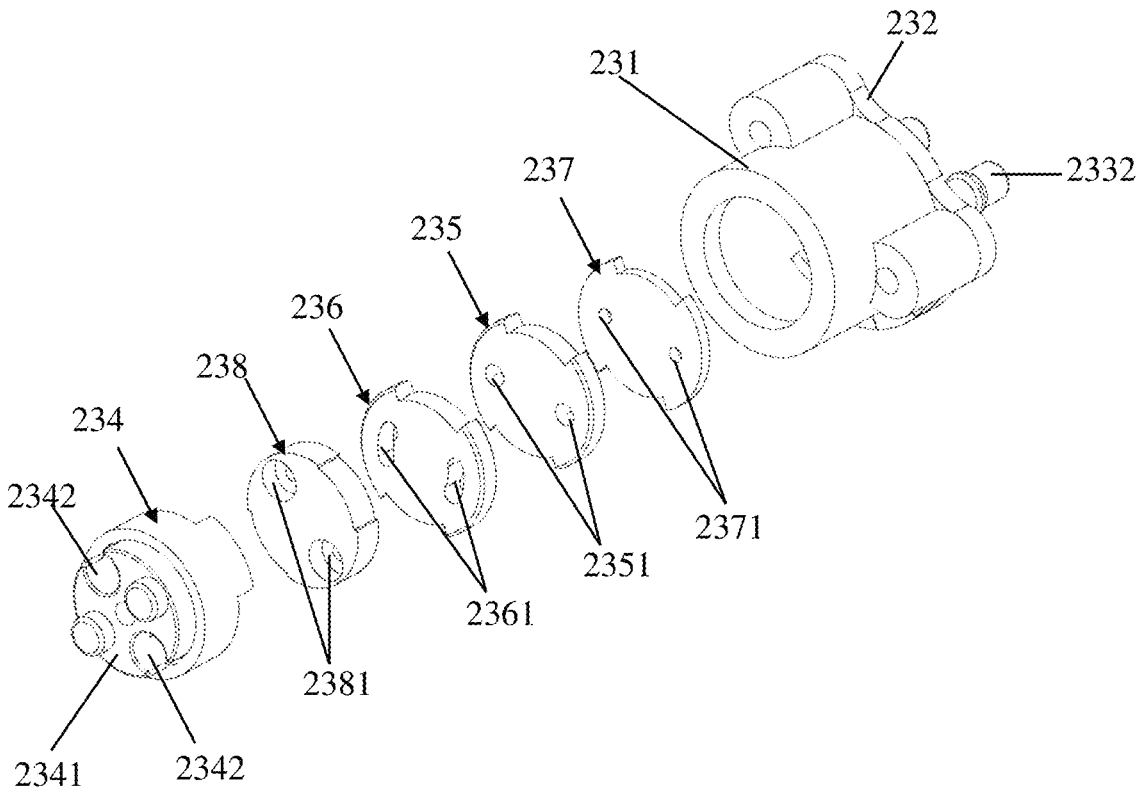
FIG. 12 is an exploded view of the diverting valve inlet end at a first view angle.

In an embodiment, as shown in FIGS. 11 and 12, the diverting valve inlet end 23 comprises a fixing sleeve 231 and an end cap 232 connected with the fixing sleeve 231.

The cold water inlet joint 2331 and the hot water inlet joint 2332 are connected with the end cap 232, respectively.

A rotating sleeve 234 is mounted in the fixing sleeve 231, and a partition 2341 is provided in the rotating sleeve 234.

A first sealing piece 235 and a second sealing piece 236 attached to the first sealing piece 235 are sequentially assembled between the end cap 232 and the rotating sleeve 234.

The first sealing piece 235 has two first sealing piece through holes 2351 in communication with the cold water inlet joint 2331 and the hot water inlet joint 2332, respectively.

The second sealing piece 236 has two second sealing piece through holes 2361 in communication with the two first sealing piece through holes 2351, respectively, and the second sealing piece through holes 2361 are in an arcuate shape.

An inlet end of the cold water supply channel 2211 and an inlet end of the hot water supply channel 2212 pass through the partition 2341, respectively, and in communication with the two second sealing piece through holes 2361, respectively.

In this embodiment, the diverting valve inlet end 23 comprises a fixing sleeve 231 and an end cap 232, wherein the fixing sleeve 231 is connected with the diverting valve housing 21, and the end cap 232 is connected to one end of the fixing sleeve 231. Both the cold water inlet joint 2331 and the hot water inlet joint 2332 are connected with the end cap 232.

A rotating sleeve 234 is provided in the fixing sleeve 231. A partition 2341 is provided in the rotating sleeve 234. Specifically, the rotating sleeve 234 is pivotably mounted in the fixed sleeve 231. The rotating sleeve 234 and the end cap 232 are located at the opposite ends of the sealing pieces.

A first sealing piece 235 and a second sealing piece 236 are assembled between the rotating sleeve 234 and the end cap 232, wherein the first sealing piece 235 is at one side proximate to the end cap 232, and the second sealing piece 236 is at one side proximate to the rotating sleeve 234. The first sealing piece 235 and the second sealing piece 236 are fixedly assembled between the rotating sleeve 234 and the end cap 232. The rotating sleeve 234 is capable of rotating with the rotating valve core 22 as a whole, while the first sealing piece 235 and the second sealing piece 236 do not move.

The first sealing piece 235 has two first sealing piece through holes 2351, wherein one of the first sealing piece through holes 2351 is kept in communication with the outlet of the cold water inlet joint 2331, and the other first sealing piece through hole 2351 is kept in communication with the outlet of the hot water inlet joint 2332.

The second sealing piece 236 has two second sealing piece through holes 2361 which are in communication with the two first sealing piece through holes 2351, respectively. The second sealing piece through holes 2361 are in an arcuate shape, and the center of the second sealing piece 236 is the center of the arcuate second sealing piece through holes 2361.

The partition 2341 is provided with two partition insertion holes 2342 which are circular holes and configured as being in correspondence with the two second sealing plate through holes 2361, respectively.

The inlet end of the cold water supply channel 2211 passes through one partition insertion hole 2342 of the partition 2341 and is in communication with one second sealing piece through hole 2361, which is in communication with the outlet of the cold water inlet joint 2331. The inlet end of the hot water supply channel 2212 passes through the other partition insertion hole 2342 of the partition 2341, and is in communication with the other second sealing piece through hole 2361, which is in communication with the outlet of the hot water inlet joint 2332.

During the rotation of the rotating valve core 22, the rotating sleeve 234 rotates with the rotating valve core 22 as a whole; and during rotation, the inlet ends of the cold water supply channel 2211 and the hot water supply channel 2212 always stay between the two ends of their corresponding arcuate second sealing piece through holes 2361, respectively, remaining in communication with their corresponding second sealing piece through holes 2361. Cold water enters the cold water supply channel 2211 via the cold water inlet joint 2331, one first sealing piece through hole 2351, and one second sealing piece through hole 2361. Hot water enters the hot water supply channel 2212 via the hot water inlet joint 2332, the other first sealing piece through hole 2351, and the other second sealing piece through hole 2361.

In an embodiment, as shown in FIGS. 11 and 12, the first sealing piece 235 and the second sealing piece 236 are ceramic sealing pieces, respectively, which bring a good sealing effect, and satisfy the sealing requirements for the high pressure water at the diverting valve inlet end 23.

In an embodiment, as shown in FIGS. 11 and 12, a first spacer 237 is assembled between the end cap 232 and the first sealing piece 235, wherein the first spacer 237 has two first spacer through holes 2371 in communication with the two first sealing piece through holes 2351, respectively.

A second spacer 238 is assembled between the partition 2341 and the second sealing piece 236, wherein the second spacer 238 has two second spacer through holes 2381 in communication with the two second sealing piece through holes 2361, respectively.

In this embodiment, the first spacer 237 is assembled between the end cap 232 and the first sealing piece 235, wherein the first spacer 237 is a rubber spacer to avoid the friction between the first sealing piece 235 and the end cap 232. The first spacer 237 has two second spacer through holes 2371 which are in communication with the two first sealing piece through holes 2351, respectively.

A second spacer 238 is assembled between the partition 2341 and the second sealing piece 236, wherein the second spacer 238 is a rubber spacer to avoid the friction between the second sealing piece 236 and the partition 2341. The second spacer 238 has two second spacer through holes 2381, which are in communication with the two second sealing piece through holes 2361, respectively.

In an embodiment, as shown in FIGS. 5, 6, 9, 11, and 12, an inlet end of the cold water supply channel 2211 is connected with a cold water inlet end plug joint 2241, and an inlet end of the hot water supply channel 2212 is connected with a hot water inlet end plug joint 2242.

The partition 2341 is provided with two partition through holes 2342 for the cold water inlet end plug joint 2241 and the hot water inlet end plug joint 2242 to pass through.

The cold water inlet end plug joint 2241 and the hot water inlet end plug joint 2242 pass through the two partition through holes 2342 and are inserted into the two second spacer through holes 2381, respectively.

In this embodiment, the inlet end plug joints 224 comprise a cold water inlet end plug joint 2241 and a hot water inlet end plug joint 2242. The cold water inlet end plug joint 2241 is connected to the inlet end of the cold water supply channel 2211, and the hot water inlet end plug joint 2242 is connected to the inlet end of the hot water supply channel 2212. The two partition through holes 2342 in the partition 2341 are circular holes, and the two second spacer through holes 2381 are step-shaped holes. The aperture of the step-shaped hole toward the side of the partition 234 is larger than its corresponding aperture toward the side of the end cap 232, and the aperture of the step-shaped hole toward the side of the end cap 232 is smaller than the width of the arcuate second sealing piece through hole 2361 and the step-shaped hole always stays between the two ends (i.e., the edges at the two sides) of its corresponding arcuate second sealing piece through hole 2361.

While assembling, the cold water inlet end plug joint 2241 and the hot water inlet end plug joint 2242 pass through the two partition through holes 2342 and are inserted in the two second spacer through holes 2381, respectively, to realize the communication between the cold water inlet end plug joint 2241 and the cold water inlet joint 2331, and the communication between the hot water inlet end plug joint 2242 and the hot water inlet joint 2332.

Figure 3:
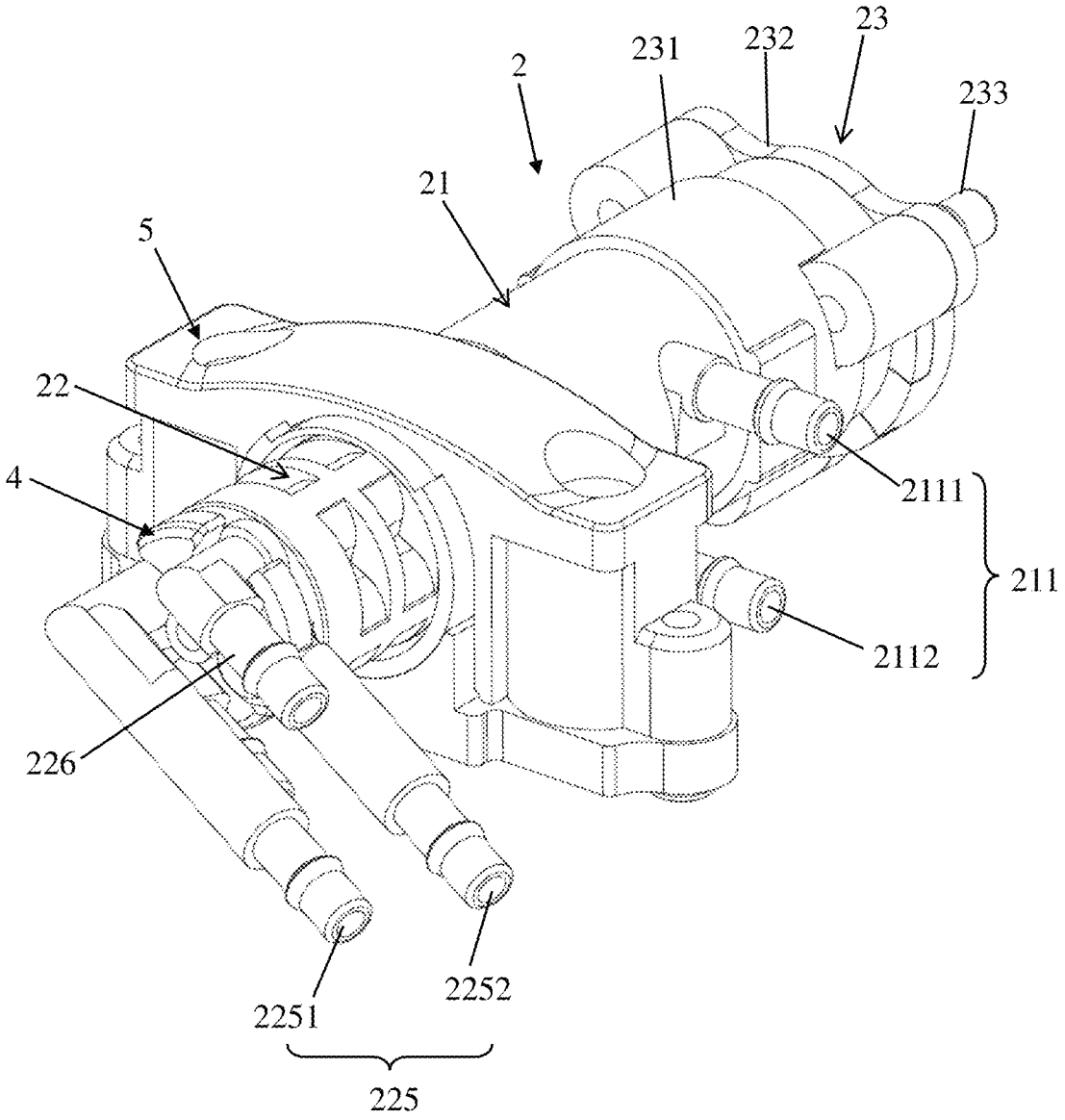
FIG. 3 is a schematic diagram of the assembling of a connecting base, a chuck and a waterway diverting valve.
Figure 4:
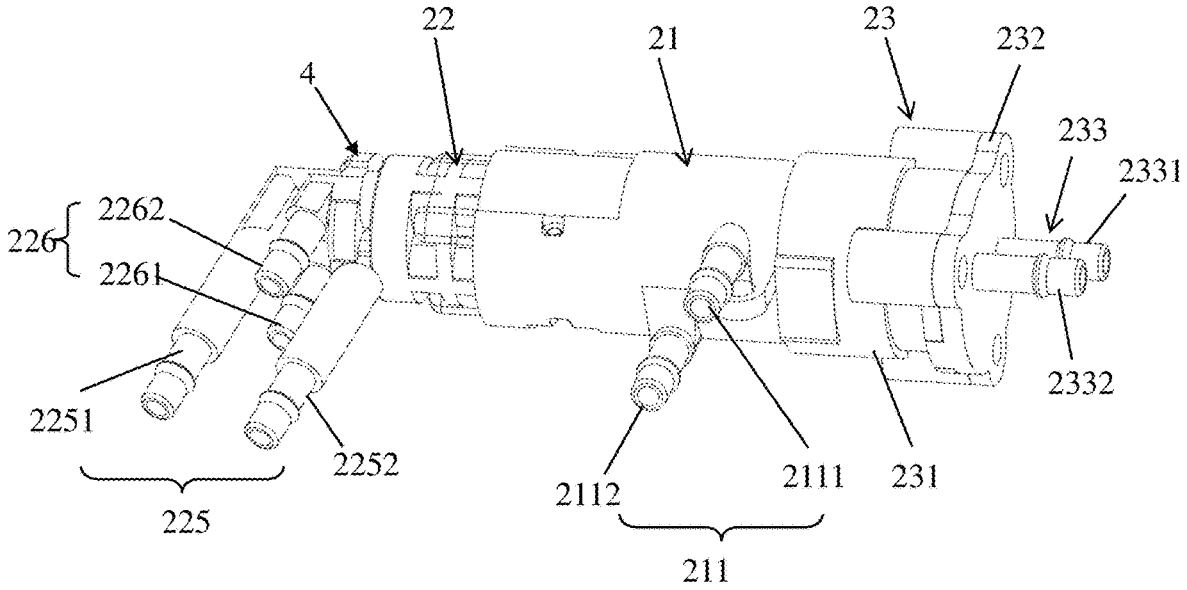
FIG. 4 is a schematic diagram of the assembling of the chuck and the waterway diverting valve, which has a waterway diverting structure.
Figure 5:
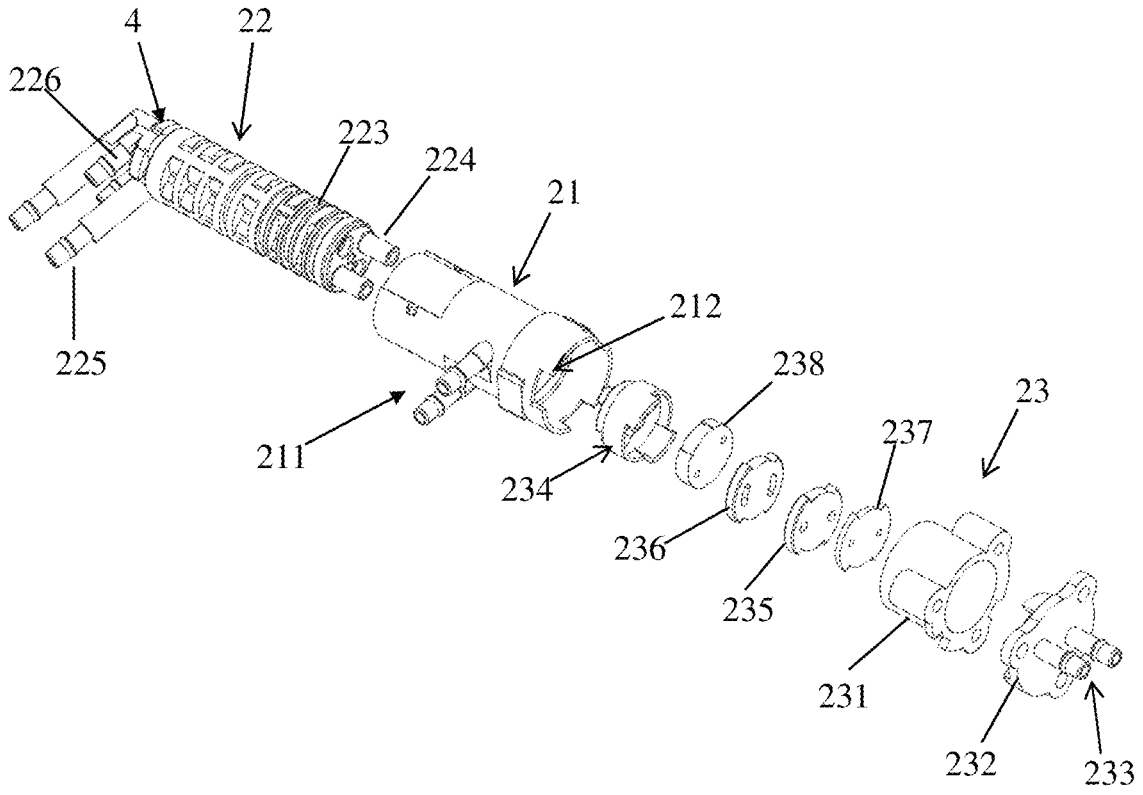
FIG. 5 is an exploded view of the waterway diverting structure as shown in FIG. 4.

In an embodiment, as shown in FIGS. 1-3, the diverting valve housing 21 is connected with a fixing base (e.g., a connecting base 5) for being connected with the rear base 7 of the seat 6. The connecting base 5 is used to connect with the rear base 7 in order to securely mount the waterway diverting valve 2 in the rear base 7.

As shown in FIGS. 13-18, a seat structure provided by an embodiment of the present disclosure comprises a seat 6, a rear base 7 connected to a rear end of the seat 6, the flushing spray pipes 8 assembled in the seat 6 and/or the rear base 7 and capable of being extended and retracted, and a seat waterway system according to any one of above-mentioned embodiments.

A rear end of the seat 6 is connected with the pivot sleeves 63 which are pivotably connected with the rear base 7.

The control mechanism 1 is mounted at one side of the seat 6.

The waterway diverting valve 2 is mounted in the rear base 7, wherein the rotating valve core 22 is coaxially arranged with the pivot sleeves 63 and capable of rotating with them as a whole A switching valve outlet 112 of the spray pipe switching valve 11 is in communication with a flushing spray pipe 8.

The seat structure provided by an embodiment of the present disclosure comprises a seat 6, a rear base 7, the flushing spray pipes 8 and a seat waterway system.

With respect to the structure, the construction and the working principle of the seat waterway system, please refer to the previous description for the seat waterway system, which will not be repeated here.

The rear base 7 is connected to a rear portion of the seat 6 which is pivotably connected with the rear base 7. The seat 6 and/or the rear base 7 are configured with the flushing spray pipes 8 which are extendable and retractable. The structure and the manner of mounting the flushing spray pipes 8 in the seat 6 or the rear base 7 are available in the prior art, which will not be described in detail herein.

The rear end of the seat 6 is provided with the pivot sleeves 63 which are pivotably connected with the rear base 7. The seat 6 rotates with the pivot sleeves 63 as a whole to be open upwardly or closed downwardly.

The control mechanism 1 is mounted at one side of the seat 6 and on the front side of the pivot sleeves 63.

The waterway diverting valve 2 is fixedly mounted in the rear base 7, wherein the rotating valve core 22 is coaxially arranged with the pivot sleeves 63 and capable of rotating with them as a whole. The rotating valve core 22 may be directly connected with the pivot sleeves 63, or it may be connected via a connection mechanism.

A switching valve outlet 112 of the spray pipe switching valve 11 is connected with a flushing spray pipe 8 through a water pipe.

The number of the flushing spray pipes 8 can be arranged as desired.

The user may operate the spray pipe switching valve 11 to control the on-off of the flushing spray pipes 8 or the switching of the waterways. The spray pipe switching valve 11 may be a touch control valve with a touch panel or a mechanical valve with a mechanical handle 113. The touch panel and the mechanical handle 113 are mounted at one side of the seat 6, facilitating the operation of the user.

Hereby, in the seat structure provided by the present disclosure, the waterway diverting valve 2 is fixedly mounted in a rear base 7, an inlet joint 233 is kept fixed, and the water pipe connected between a water source and an inlet joint 233 no longer needs to move along with the seat 6. Such a stable structure reduces the possibility of leakage. The control mechanism 1 is at one side of the seat 6, and the rotating valve core 22 of the waterway diverting valve 2 is capable of rotating with the seat 6 as a whole, so that the water pipe connected between the rotating valve core 22 and the control mechanism 1 can move with the seat 6 as a whole, facilitating the waterway arrangement in the seat 6.

Figure 15:
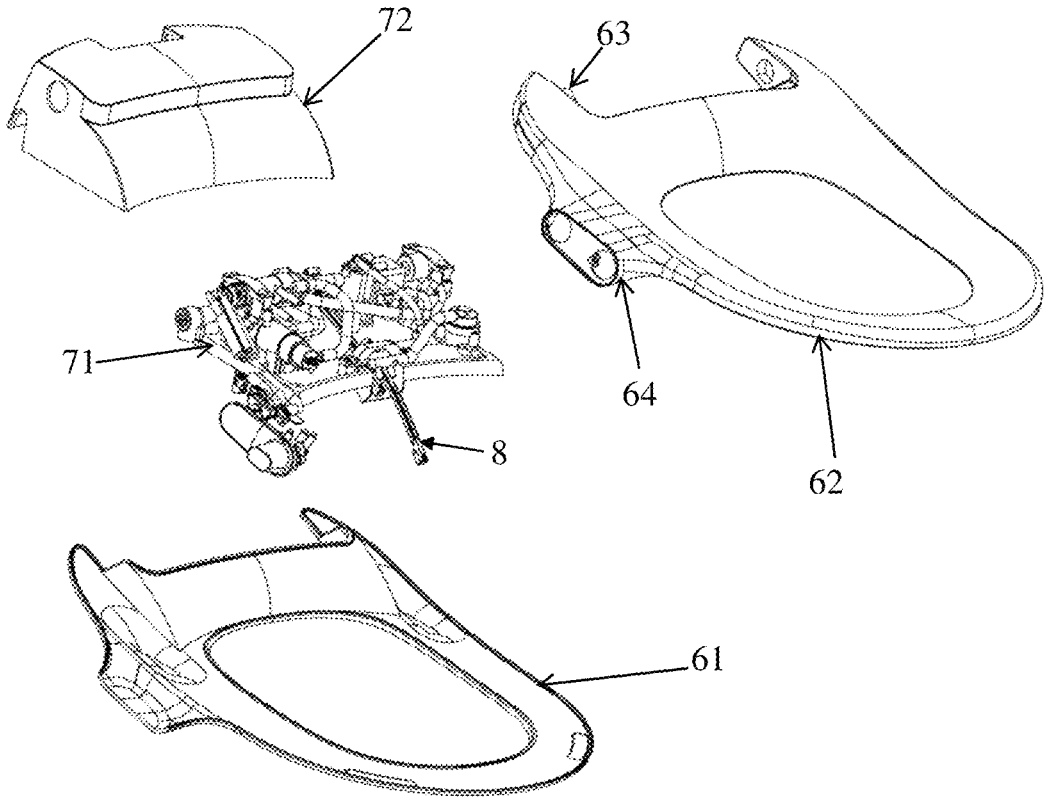
FIG. 15 is an exploded view of a seat structure provided by an embodiment of the present disclosure.
Figure 16:
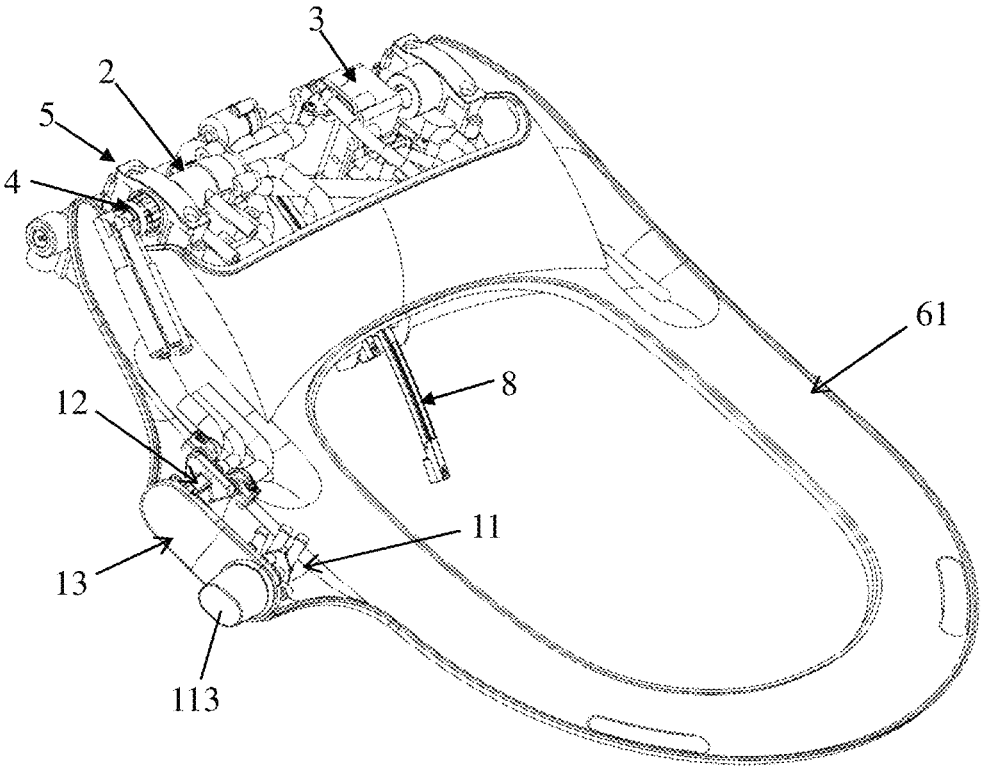
FIG. 16 is a structural schematic diagram of a seat structure provided by an embodiment of the present disclosure, with the seat cover plate and the rear base cover plate removed.
Figure 17:
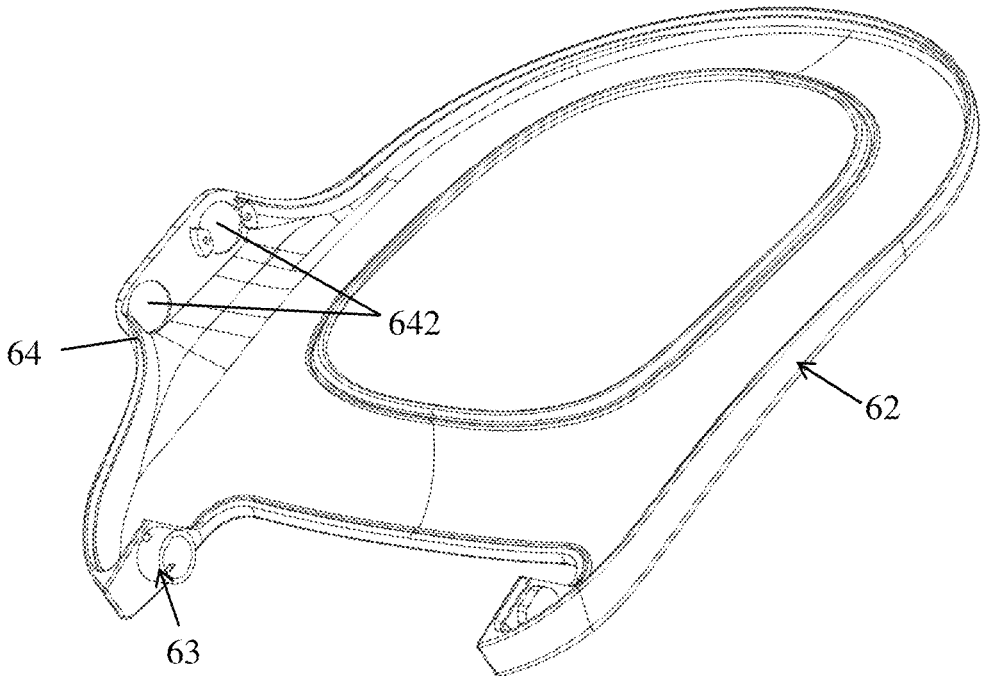
FIG. 17 is a perspective view of a seat cover plate.
Figure 18:
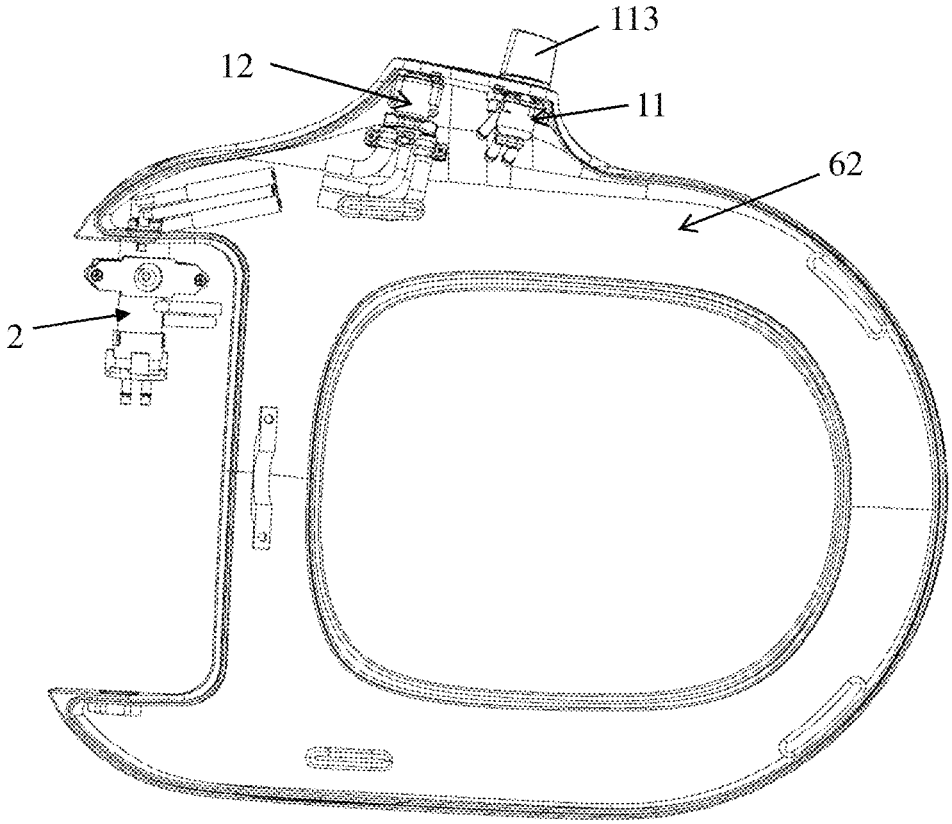
FIG. 18 is a schematic diagram of the assembling of a control mechanism, a waterway diverting valve and a seat cover plate.
Figure 19:
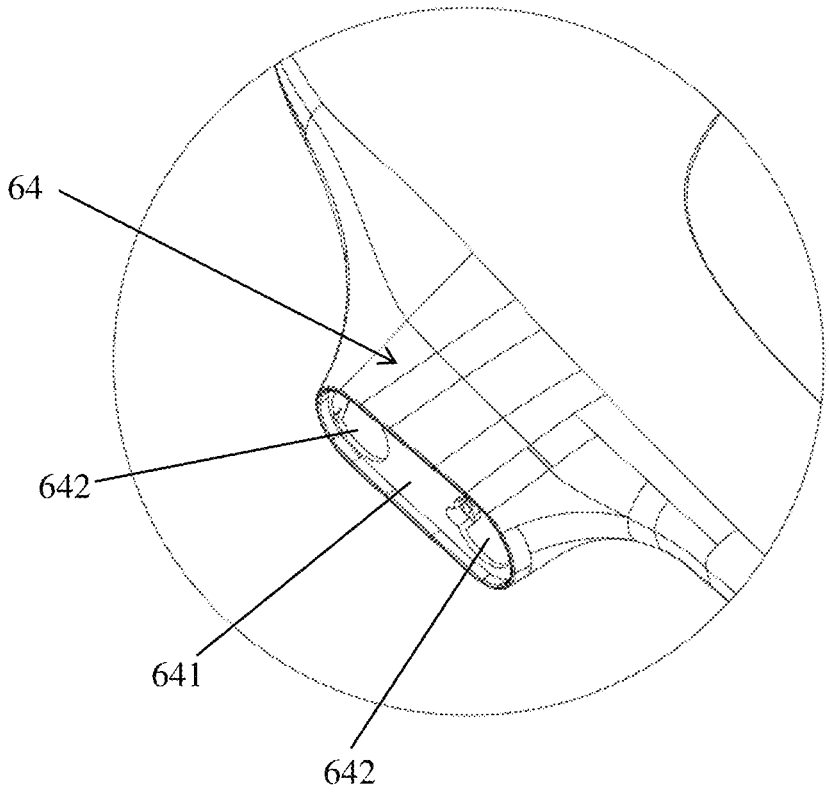
FIG. 19 is an enlarged schematic diagram of a seat extension portion.
Figure 20:
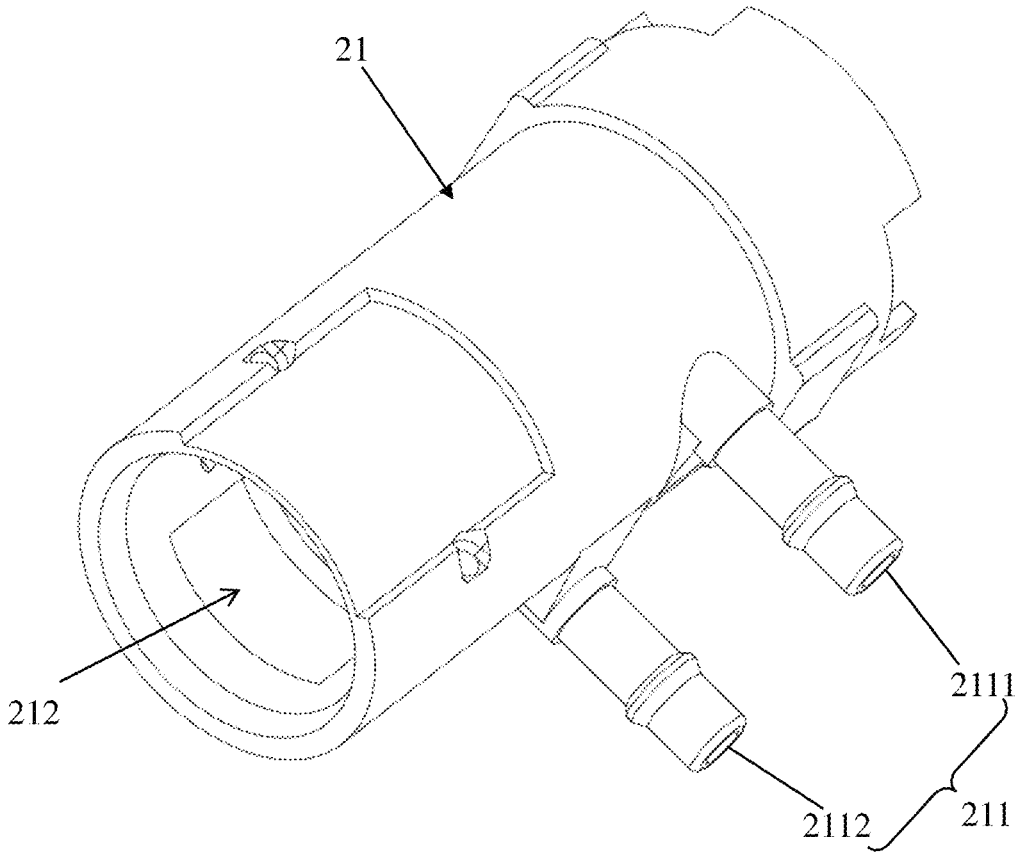
FIG. 20 is a perspective view of a diverting valve housing.

In an embodiment, as shown in FIG. 15, the seat 6 comprises a seat bottom plate 61 and a seat cover plate 62 connected to the seat bottom plate 61, with a cavity formed therebetween for mounting the control mechanism 1 in the cavity at one side, which may also be used for mounting the flushing spray pipes 8. The rear base 7 comprises a rear base bottom plate 71 and a rear base cover plate 72 connected to the rear base bottom plate 71, with a mounting cavity formed therebetween for mounting the waterway diverting valve 2 in the mounting cavity, which may also be used for mounting the flushing spray pipes 8 or the like.

In an embodiment, as shown in FIGS. 1, 2, 13, and 14, the spray pipe switching valve 11 comprises a mechanical handle 113 which extends outwardly to an outer side of the seat 6.

In this embodiment, the spray pipe switching valve 11 is a mechanical valve comprising a mechanical handle 113. One side portion of the seat 6 is provided with through holes 642, and the mechanical handle 113 passes through a through hole 642 and extends outwardly to the outer side of the seat 6, to allow a user to hold the mechanical handle 113 to operate the spray pipe switching valve 11.

In an embodiment, as shown in FIGS. 1 and 3-9, the valve body 21 is provided with spray pipe joints 211.

The rotating valve core 22 has water returning channels 222. An inlet of a water returning channel 222 is in communication with a switching valve outlet 112.

An outer peripheral surface of the rotating valve core 22 has water guiding grooves 223 in communication with the water returning channels 222. A spray pipe joint 211 is in communication with a water guiding groove 223.

A spray pipe joint 211 is in communication with a flushing spray pipe 8.

In this embodiment, the diverting valve housing 21 is configured with spray pipe joints 211 for connecting with the flushing spray pipes 8 through water pipes, to supply water to the flushing spray pipes 8.

The rotating valve core 22 is configured with water returning channels 222, the inlets of which are at an end toward the control mechanism 1, and the other ends of the water returning channels 222 are enclosed. The inlets of the water returning channels 222 are connected with the switching valve outlets 112 through the water pipes.

An outer peripheral surface of the rotating valve core 22 is provided with water guiding grooves 223 which extend in a circumferential direction of the outer peripheral surface of the rotating valve core 22. The groove bottoms of the water guiding grooves 223 are in communication with the water returning channels 222 via the through holes.

Waterways are formed between the water guiding grooves 223 and the diverting valve housing 21. While the rotating valve core 22 is rotating, the spray pipe joints 211 do not move, but the inlets of the spray pipes joints 211 always stay between the two ends of a water guiding groove 223, and the inlets of the spray pipe joints 211 are kept in communication with a water guiding groove 223, supplying water to the spray pipe joints 211.

With such an arrangement, there is no need to directly connect an inlet of a spray pipe joint 211 with a switching valve outlet 112 through a water pipe. Thus, the length of the water pipe between an inlet of a spray pipe joint 211 and a switching valve outlet 112 is reduced. A fastener for fixing a long water pipe is no longer needed. Flushing water is delivered through the water returning channels 222 of the rotating valve core 22. Such an arrangement is highly integrated and provides a stable connection.

In an embodiment, as shown in FIGS. 3-6 and 16-18, the inlets of the water returning channels 222 and the outlets of the water supply channels 221 are at the same end of the rotating valve core 22.

An outlet of the water supply channel 221 is connected with a water supply joint 225, and an inlet of the water returning channel 222 is connected with a water returning joint 226.

The seat waterway system comprises a chuck 4, a circumferential surface of which is provided with a plurality of the slots 41 at intervals, wherein the water supply joints 225 and the water returning joints 226 are clamped in the slot 41, respectively.

The chuck 4 is clamped with a pivot sleeve 63.

In this embodiment, the inlets of the water returning channels 222 and the outlets of the water supply channels 221 are configured at one end of the rotating valve core 22 proximate to the control mechanism 1, and the water supply joints 225 and the water returning joints 226 are configured, respectively, so as to connect the switching valve inlets 111 with the water supply joints 225 through the water pipes, which also facilitates to connect the switching valve outlets 112 with the water returning joints 226 through the water pipes. The water supply joints 225 and the water returning joints 226 are rigid plastic pipes which can pass through the pivot sleeve 63. As needed, they can be configured as an L-shape to facilitate the communication between the water supply channels 221 and the spray pipe switching valves 11 and the communication between the spray pipe switching valve 11 and the water returning channels 222.

One end of the rotating valve core 22 is configured with the chuck 4 which may be connected with the rotating valve core 22 as well as arranged at an interval from the rotating valve core 22. The chuck 4 is used to be clamped with a pivot sleeve 63. Thus, the chuck 4 can be rotated with the seat 6 as a whole. The chuck 4 is provided with more than two slots 41 along the circumferential direction. The water supply joints 225 and the water returning joints 226 are clamped in the slots 41, respectively. While rotating, the chuck 4 drives the water supply joints 225 and the water returning joints 226 to rotate with it as a whole, which in turn drives the rotating valve core 22 to rotate with them as a whole. Thus, the arrangements of the water pipes connected between the spray pipe switching valve 11 and the water supply joints 225 and the water pipes connected between the spray pipe switching valve 11 and the water returning joints 226 will not be affected.

Figure 13:
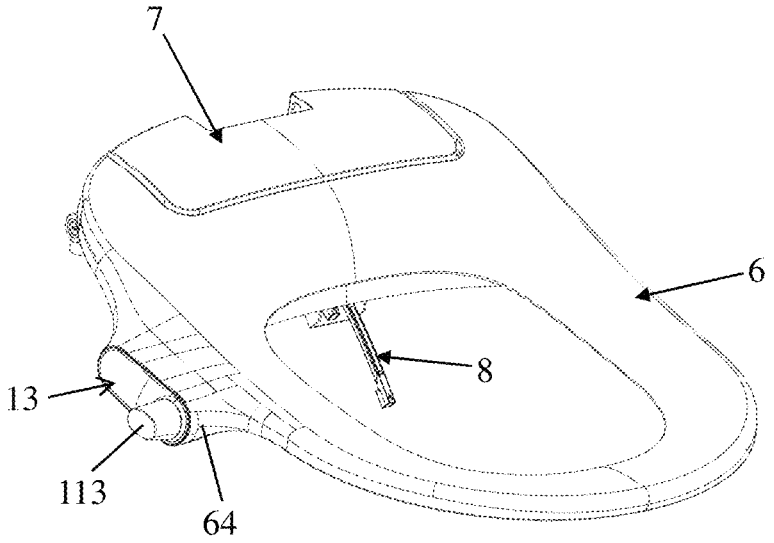
FIG. 13 is a perspective view of a seat structure provided by an embodiment of the present disclosure under a first view angle.
Figure 14:
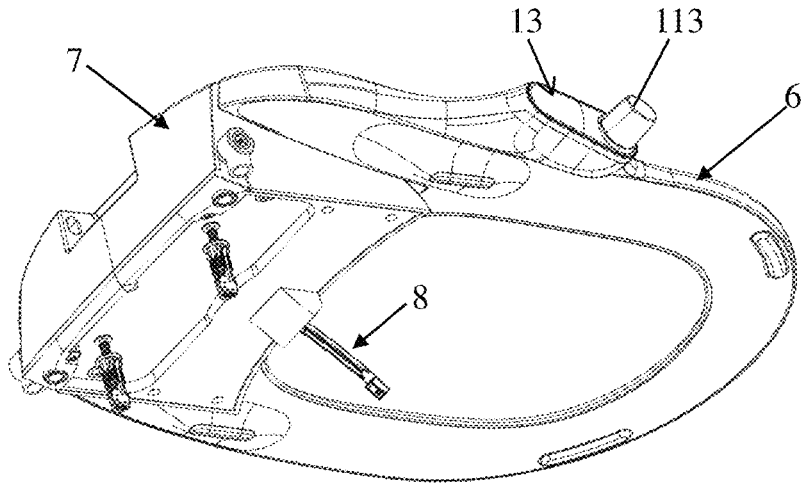
FIG. 14 is a perspective view of a seat structure provided by an embodiment of the present disclosure under a second view angle.

In an embodiment, as shown in FIGS. 13-15, one side of the seat 6 has a seat extension portion 64, in which the control mechanism 1 is mounted.

In this embodiment, one side of the seat 6 is configured with a seat extension portion 64 to provide the mounting space for mounting the control mechanism 1.

In an embodiment, as shown in FIGS. 1, 2, 13-16, FIG. 19, the control mechanism 1 comprises a trim plate 13, with which the spray pipe switching valve 11 is connected.

An outer surface of the seat extension portion 64 has an extension recess 641, in which the trim plate 13 is assembled.

In this embodiment, the control mechanism 1 comprises a trim plate 13, with which both the spray pipe switching valve 11 and the mixing valve 12 are connected. The trim plate 13 provides the mounting support for the spray pipe switching valve 11 and the mixing valve 12. The outer surface of the seat extension portion 64 has an extension portion recess 641, the recess bottom of which is provided with a corresponding number of the through holes 642 for the mixing valve 12, the spray pipe switching valve 11 or the mechanical handle 113 to pass through. The trim plate 13 is assembled in the extension portion recess 641, which not only meets the function of a decoration for the appearance, but also provides the support for mounting the spray pipe switching valve 11 and the mixing valve 12.

An embodiment of the present disclosure provides a toilet comprises a seat structure according to any one of the preceding embodiments. The rear base 7 of the seat structure is fixedly mounted at the rear portion of the toilet, and the seat 6 of the seat structure is on the ceramic cylinder of the toilet.

The above technical solutions may be combined as required to achieve the best technical effect.

The above are merely the principle and the embodiments of the present disclosure. It should be pointed out that, for those of ordinary skill in the art, other variations may be made on the basis of the principle of the present disclosure, which should also be regarded as falling in the protection scope of the present disclosure.

Embodiment 2

The specific embodiments of the present disclosure are further described with reference to the drawings hereinafter. Same or equivalent parts are denoted by the same reference numerals. It should be noted that, the terms "front", "rear", "left", "right", "up" and "down" used in the following description refer to the directions in the drawings, and the terms "inner" and "outer" refer to the directions towards or far away from the geometric centers of specific parts, respectively.

As shown in FIGS. 4-9 and 20, a waterway diverting structure provided by an embodiment of the present disclosure comprises a diverting valve housing 21 with flushing joints (e.g., spray pipe joints 211), a rotating valve core 22 with outlet joints (e.g., water supply joints 225) and the water returning joints 226, and an inlet end (e.g., a diverting valve inlet end 23) with the inlet joints 233.

The diverting valve inlet end 23 is fixedly mounted at one end of the diverting valve housing 21. The rotating valve core 22 is at least partially pivotably assembled in the diverting valve housing 21. One end of the rotating valve core 22 away from the diverting valve inlet end 23 is connected with the water supply joints 225 and the water returning joints 226.

The rotating valve core 22 has outlet channels (water supply channels 221) in communication with the inlet joints 233 and the water supply joints 225.

The rotating valve core 22 also has the water returning channels 222 in communication with the water returning joints 226, wherein an outer peripheral surface of the rotating valve core 22 is provided with diverting grooves (e.g., water guiding grooves 223) in communication with the water returning channels 222, and the flushing joints 12 are in communication with the water guiding grooves 223.

A waterway diverting structure provided by an embodiment of the present disclosure comprises a diverting valve housing 21, a rotating valve core 22, and a diverting valve inlet end 23.

The diverting valve housing 21 is in the shape of a cylinder, and a through hole 212 or a mounting cavity is provided therein. The diverting valve housing 21 is used for being fixed in the rear base of the seat 6 shown in FIG. 24. The spray pipe joints 211 are mounted at an outer side of the diverting valve housing 21. When being assembled, the spray pipe joints 211 are connected with a flush assembly (spray pipes) of the seat 6 through water pipes for a user to clean a privacy area.

One end of the rotating valve core 22 is inserted into the through hole 212 or the mounting cavity of the diverting valve housing 21, and the other end of the rotating valve core 22 can extend outwardly to an outer side the diverting valve housing 21. The rotating valve core 22 is capable of rotating relative to the diverting valve housing 21. When being assembled, the rotating valve core 22 is coaxially configured with the pivot sleeves 63 at a rear portion of the seat 6. When the seat 6 is rotating around the pivot sleeves 63, the rotating valve core 22 is rotatable with the seat 6 as a whole.

The rotating valve core 22 has mutually independent water supply channels 21 and water returning channels 222, wherein an end of the rotating valve core 22 extending out of a side of the diverting valve housing 21 is connected with the water supply joints 225 and the water returning joints 226, and an outer peripheral surface of the rotating valve core 22 is provided with the water guiding grooves 223.

The diverting valve inlet end 23 is assembled at one end of the diverting valve housing 21 and is arranged at an opposite end of the diverting valve housing 21 relative to the water supply joints 225 and the water returning joints 226. A housing (e.g., a fixing sleeve 231) of the diverting valve inlet end 23 is connected with the diverting valve housing 21 through pins, bolts and the like. The inlet joints 233 are mounted on the fixing sleeve 231 and used for connecting with the water supply pipes. A water supply pipe may be a tap water supply pipe, an outlet pipeline of a temperature control valve, and the like. As need, an inlet joint 233 can be connected so as to provide only cold water, only hot water, or only pre-mixed warm water. The cold water may be any liquid, including water, having a temperature lower than a first predetermined temperature. The hot water may be any liquid, including water, having a temperature higher than a second predetermined temperature. The warm water may be any liquid, including water, having a temperature between the first predetermined temperature and the second predetermined temperature. The second predetermined temperature is higher than the first predetermined temperature.

An inlet end of a water supply channel 221 is in communication with an outlet end of an inlet joint 233, wherein the two may be sleeved or plugged together, or may be connected via a diverting mechanism. When an inlet end of a water supply channel 221 is rotating with the rotating valve core 22 as a whole, the water from an inlet joint 233 may also be supplied to the water supply channel 221. As needed, a plug joint (e.g., an inlet end plug joint 224) can be assembled at an inlet end of the water supply channel 221, and a inlet end plug joint 224 and an outlet end of an inlet joint 233 are directly cooperated, (for example, plugged or sleeved); a inlet end plug joint 224 and an outlet end of the inlet joint 233 can also be indirectly cooperated (for example, by using the structure of a diverting ring, a diverting cavity, and the like for a diverting connection). The Water in a water supply channel 221 flows out through a water supply joint 225. When being assembled, the water supply joint 225 is connected with an inlet of a control valve (e.g., a spray pipe switching valve 11) of the seat 6 through a water pipe, wherein the spray pipe switching valve 11 may be a switching valve and/or a mixing valve. When being assembled, a water returning joint 226 is connected with an outlet of the spray pipe switching valve 11 of the seat 6 through a water pipe, so as to deliver the water discharged from the spray pipe switching valve 11 to a water returning channel 222. The water guiding grooves 223 are in communication with the water returning channels 222 via through holes, and the water from the water returning channels 222 is discharged into the water guiding grooves 223 via the through holes. The water guiding grooves 223 are provided on an outer peripheral surface of the rotating valve core 22, wherein the water guiding grooves 223 are substantially perpendicular to a radial direction of the rotating valve core 22, and the water guiding grooves 223 are sealed from a hole-wall of the through-hole 11 of the diverting valve housing 21, so as to form the waterways. When the rotating valve core 22 is rotating, the spray pipe joints 211 are kept in communication with the water guiding grooves 223, so that the water can be delivered to the flushing assembly of the seat 6.

As can be seen, the waterway diverting structure provided by the present disclosure may divert the waterways to the spray pipe switching valve 11 of the seat 6, as well as divert the water outputted from the spray pipe switching valve 11 to the flushing assembly of the seat 6. Therefore, the arrangements of the water pipes in the seat 6 can be optimized. Instead of being directly connected through a water pipe as before, the spray pipe switching valve 11 and the flushing assembly are transitioned via a waterway diverting structure, which shortens the length of the water pipe in the seat 6. There is no need to use a special fixing structure to fix a water pipe connected between the spray pipe switching valve 11 and the flushing assembly, which simplifies the manner of mounting the waterways and saves the mounting space.

In the waterway diverting structure provided by the present disclosure, the rotating valve core 22 can be rotated with the seat 6 as a whole. When the seat 6 is rotating, the spray pipe switching valve 11, the rotating valve core 22, the water supply joints 225, the water returning joints 226, the water pipes connected between the water supply joints 225 and the spray pipe switching valve 11, and the water pipes connected between the water returning joints 226 and the spray pipe switching valve 11 are simultaneously driven to rotate together as a whole, so that the spray pipe switching valve 11 can be mounted at one side of the seat, which facilitates the use of an user.

Figure 6:
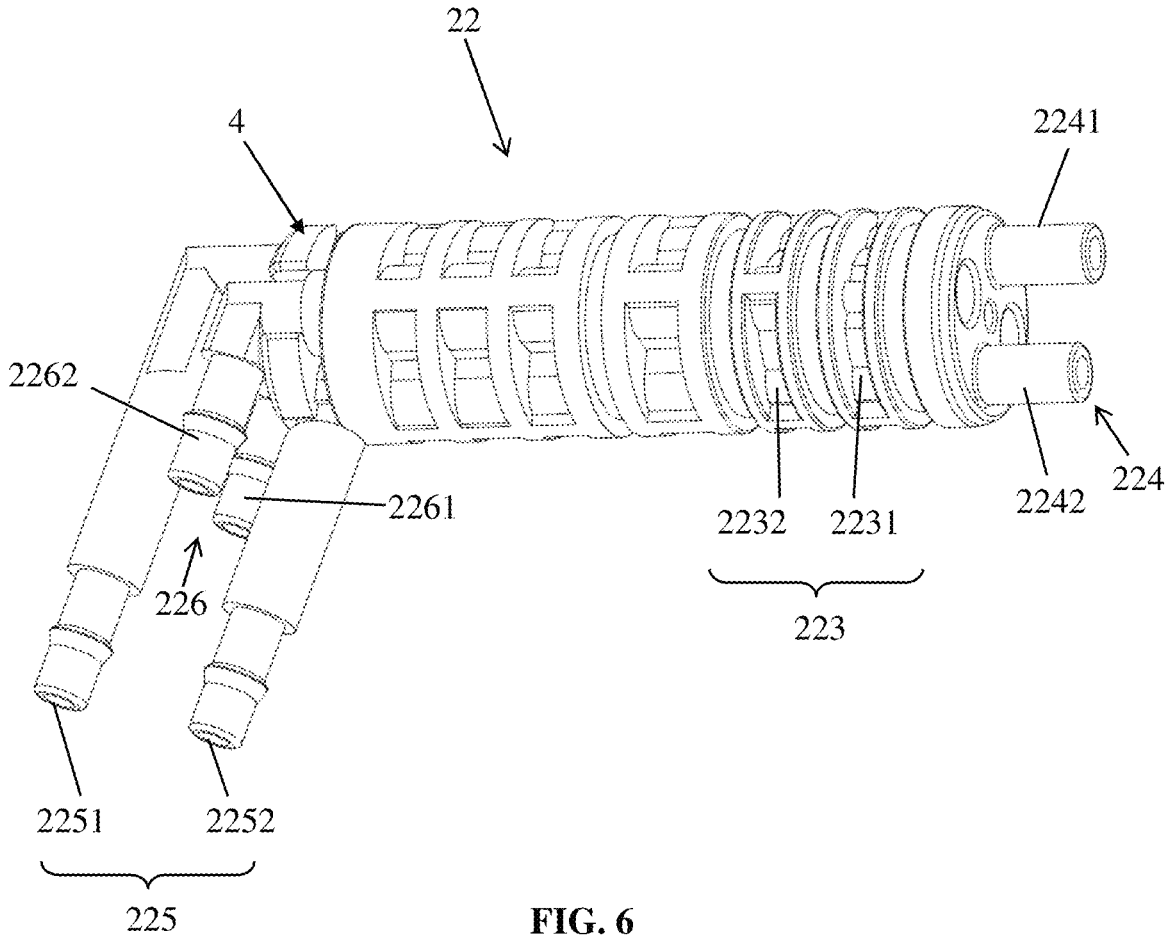
FIG. 6 is a schematic diagram of the assembling of the chuck, a water supply joint, a water returning joint, a rotating valve core, and a diverting valve housing.
Figure 7:
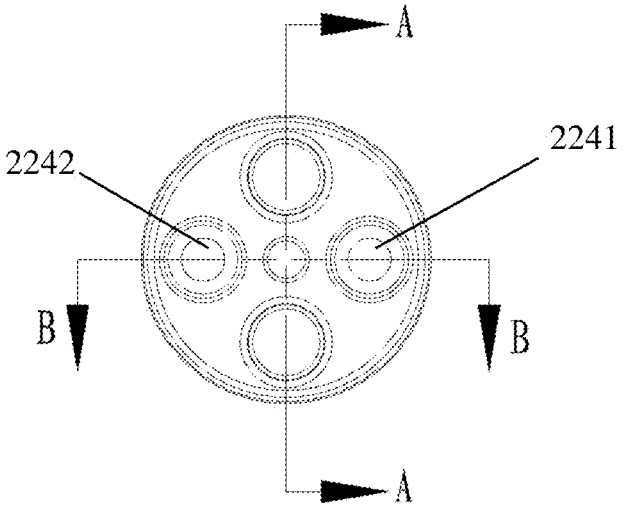
FIG. 7 is an end view of the rotating valve core observed from an inlet end side.
Figure 8:
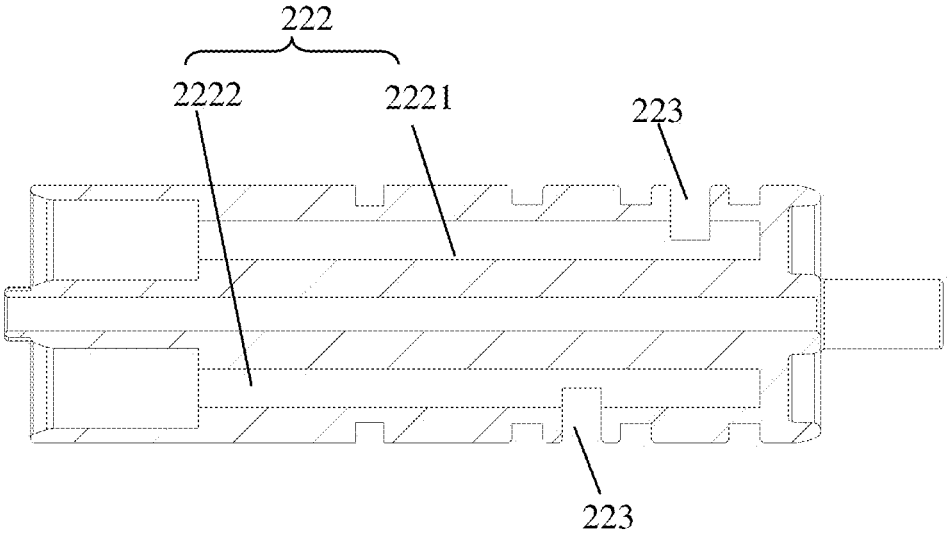
FIG. 8 is a section view along the A-A direction in FIG. 7.
Figure 9:
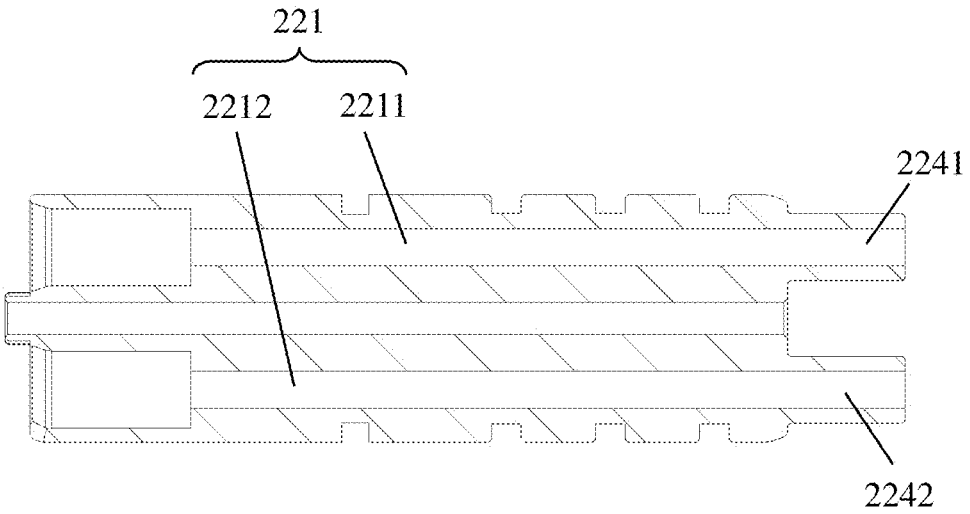
FIG. 9 is a section view along the B-B direction in FIG. 7.

In an embodiment, as shown in FIGS. 6, 8, and 9, the water guiding grooves 223 are in an arcuate or circular shape on the outer peripheral surface of the rotating valve core 22. The arcuate or annular shaped water guiding grooves 223 are coaxially arranged with the rotating valve core 22. When rotating, the rotating valve core 22 makes the arcuate or annular water guiding grooves 223 to rotate with it as a whole, and the rotating water guiding grooves 223 may remain in communication with the fixed spray pipe joints 211.

In an embodiment, a seal ring is assembled between both sides of the water guiding grooves 223 and the diverting valve housing 21. The seal ring is a rubber seal ring, which is assembled between the left and right sides of the water guiding grooves 223 and the hole-wall of the through hole 212, so as to enhance the sealing performance of the water guiding grooves 223.

In an embodiment, as shown in FIGS. 4-9 and 20, the inlet joints 233 comprise a cold water inlet joint 2331 and/or a hot water inlet joint 2332.

The water supply channels 21 comprise a cold water outlet channel (e.g., cold water supply channel 2211) and/or a hot water outlet channel (e.g., hot water supply channel 2212), wherein the cold water supply channel 2211 is in communication with the cold water inlet joint 2331, and the hot water supply channel 2212 is in communication with the hot water inlet joint 2332.

The water supply joints 225 comprise a cold water outlet joint 2251 and/or a hot water outlet joint 2252, wherein the cold water outlet joint 2251 is in communication with the cold water supply channel 2211, and the hot water outlet joint 2252 is in communication with the hot water supply channel 2212.

In this embodiment, the inlet joints 233 comprise a cold water inlet joint 2331 and/or a hot water inlet joint 2332. When being assembled, the cold water inlet joint 2331 is connected with a tap water pipeline, and the hot water inlet joint 2332 can be connected with an external hot water pipeline, or with the hot water outlet of a temperature control valve.

Accordingly, the water supply channels 21 comprise a cold water supply channel 2211 and/or a hot water supply channel 2212. When the rotating valve core 22 is rotating, an inlet end of the cold water supply channel 2211 is kept in communication with an outlet of the cold water inlet joint 2331, and an inlet end of the hot water supply channel 2212 is kept in communication with an outlet of the hot water inlet joint 2332.

The water supply joints 225 comprise a cold water outlet joint 2251 being in communication with the cold water supply channel 2211 and/or a hot water outlet joint 2252 being in communication with the hot water supply channel 2212. When being assembled, the cold water outlet joint 2251 is connected with the mixing valve of the spray pipe switching valve 11 through a water pipe, so as to supply cold water to the mixing valve. When being assembled, the hot water outlet joint 2252 is connected with the mixing valve of the spray pipe switching valve 11 through a water pipe, so as to supply hot water to the mixing valve. The mixing valve mixes the cold and hot water such that the mixed water reaches a desired temperature, and then it delivers the warm water to the switching valve of the spray pipe switching valve 11. Then the warm water is delivered to the water returning joints 226, the water returning channels 222 and the spray pipe joints 211 through the water pipes, so as to deliver the warm water to the flushing assembly.

In an embodiment, a cold water inlet end plug joint 2241 is connected with an inlet end of the cold water supply channel 2211, wherein the first plug joint (e.g., a cold water inlet end plug joint 2241) is connected with an outlet of the cold water inlet joint 2331 via a diverting ring, which has a first annular groove being in communication with an outlet of the cold water inlet joint 2331. The cold water inlet end plug joint 2241 is in communication with the first annular groove. A second plug joint (e.g., hot water inlet end plug joint 2242) is connected with an inlet end of the hot water supply channel 2212, wherein the hot water inlet end plug joint 2242 is connected with an outlet of the hot water inlet joint 2332 via a diverting ring, which has a second annular water groove being in communication with an outlet of the hot water inlet joint 2332, and the hot water inlet end plug joint 2242 is kept in communication with the second annular water groove.

Figure 22:
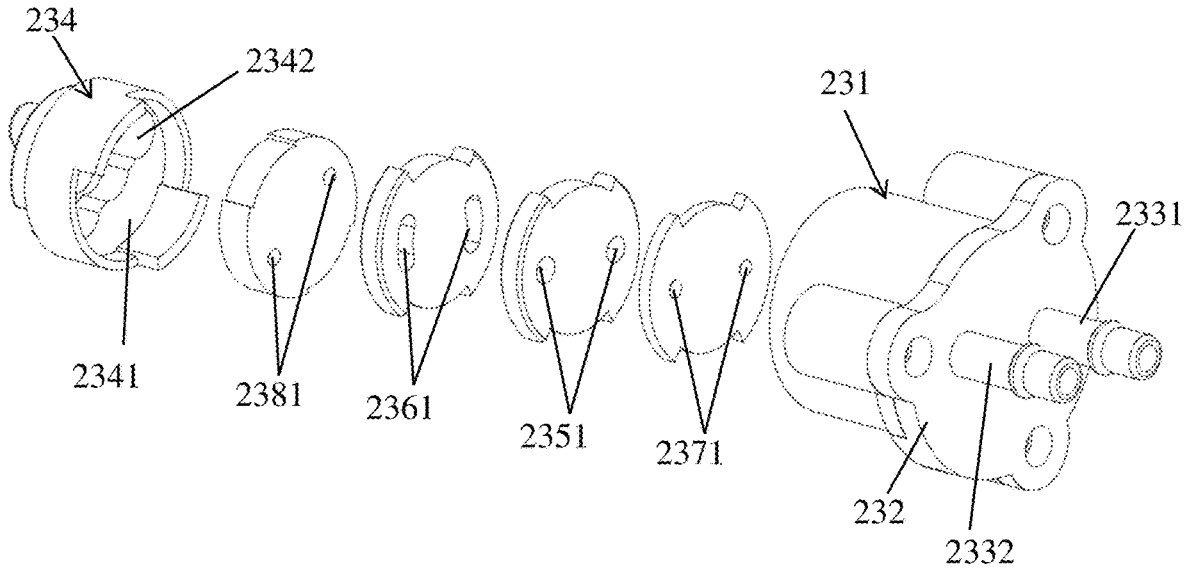
FIG. 22 is an exploded view of the diverting valve inlet end at a second view angle.

In an embodiment, as shown in FIGS. 11, 12, and 22, the diverting valve inlet end 23 comprises a rotating sleeve 234 with a partition 2341.

A first sealing piece 235 and a second sealing piece 236 attached to the first sealing piece 235 are sequentially assembled between the outlets of the cold water inlet joint 2331 and the hot water inlet joint 2332 and the rotating sleeve 234.

The first sealing piece 235 has two first sealing piece through holes 2351 in communication with the outlets of the cold water inlet joint 2331 and the hot water inlet joint 2332, respectively.

The second sealing piece 236 has two second sealing piece through holes 2361 in communication with the two first sealing piece through holes 2351, respectively, wherein the second sealing piece through holes 2361 are in an arcuate shape.

An inlet end of the cold water supply channel 2211 and an inlet end of the hot water supply channel 2212 pass through the partition 2341, respectively, and in communication with the two second sealing piece through holes 2361, respectively.

In this embodiment, an diverting valve inlet end 23 is provided with the rotating sleeve 234, inside of which is provided with a partition 2341. Specifically, the rotating sleeve 234 is pivotably mounted in the fixing sleeve 231, and the rotating sleeve 234 and the inlet joints 233 are at the opposite ends of the sealing pieces. The inlet joints 233 are mounted on the end cap 232 of the fixing sleeve 231.

A first sealing piece 235 and a second sealing piece 236 are assembled between the rotating sleeve 234 and the end cap 232, wherein the first sealing piece 235 is at a side proximate to the end cap 232, and the second sealing piece 236 is at a side proximate to the rotating sleeve 234. The first sealing piece 235 and the second sealing piece 236 are fixedly assembled between the rotating sleeve 234 and the end cap 232. The rotating sleeve 234 is capable of rotating with the rotating valve core 2 as a whole, with the first sealing piece 235 and the second sealing piece 236 remaining stationary.

The first sealing piece 235 has two first sealing piece through holes 2351, wherein one of the first sealing piece through holes 2351 is kept in communication with the outlet of the cold water inlet joint 2331, and the other first sealing piece through hole 2351 is kept in communication with the outlet of the hot water inlet joint 2332.

The second sealing piece 236 has two second sealing piece through holes 2361, which are in communication with the two first sealing piece through holes 2351, respectively. The second sealing piece through holes 2361 are in an arcuate shape, and the center of the second sealing piece 236 is the center of the arcuate second sealing piece through holes 2361.

The partition 2341 is provided with two partition insertion holes 2342, which are circular holes. The two partition insertion holes 2342 are configured as being in correspondence with the two second sealing plate through holes 2361.

The inlet end of the cold water supply channel 211 passes through one of the partition insertion holes 2342 of the partition 2341 and is in communication with one second sealing piece through hole 2361, which is in communication with the outlet of the cold water inlet joint 2331. The inlet end of the hot water supply channel 2212 passes through the other partition insertion hole 2342 of the partition 2341 and is in communication with the other second sealing piece through hole 2361, which is in communication with the outlet of the hot water inlet joint 2332.

During the rotation of the rotating valve core 2, the rotating sleeve 234 rotates with the rotating valve core 22 as a whole. During rotation, the inlet ends of the cold water supply channel 2211 and the hot water supply channel 2212 are always between the two ends of their corresponding arcuate second sealing piece through holes 2361, so as to be kept in communication with their corresponding second sealing piece through holes 2361. Cold water enters the cold water supply channel 2211 via the cold water inlet joint 2331, one first sealing piece through-hole 2351, and one second sealing piece through-hole 2361. Hot water enters the hot water supply channel 2212 via the hot water inlet joint 2332, the other first sealing piece through-hole 2351, and the other second sealing piece through-hole 2361.

In an embodiment, an inlet end of the cold water supply channel 2211 is connected with a cold water inlet end plug joint 2241, and an inlet end of the hot water supply channel 2212 is connected with a hot water inlet end plug joint 2242. The cold water inlet end plug joint 2241 and the hot water inlet end plug joint 2242 pass through the two partition insertion holes 2342 of the partition 2341, respectively, and are in communication with the two second sealing piece through holes 2361, respectively.

As the rotating valve core 22 rotates, the cold water inlet end plug joint 2241 and the hot water inlet end plug joint 2242 act on the rotating sleeve 234, causing the rotating sleeve 234 to rotate in the fixing sleeve 231. The cold water inlet end plug joint 2241 and the hot water inlet end plug joint 2242 are always in communication with their corresponding arcuate second sealing piece through holes 2361.

In an embodiment, the first sealing piece 235 and the second sealing piece 236 are ceramic sealing pieces, respectively, which have a good sealing effect and satisfy the sealing requirements for the high pressure water at the inlet end.

In an embodiment, as shown in FIGS. 12 and 22, a first spacer 237 is assembled between the outlets of the cold water inlet joint 2331 and the hot water inlet joint 2332 and the first sealing piece 235, wherein the first spacer 237 has two first spacer through holes 2371 in communication with the two first sealing piece through holes 2351, respectively.

A second spacer 238 is assembled between the partition 2341 and the second sealing piece 236, wherein the second spacer 238 has two second spacer through holes 2381 in communication with the two second sealing piece through holes 2361, respectively.

In this embodiment, the first spacer 237 is assembled between the end cap 232 and the first sealing piece 235, wherein the first spacer 237 is a rubber spacer to avoid the friction between the first sealing piece 235 and the end cap 232. The first spacer 237 has two second spacer through holes 2371, which are in communication with the two first sealing piece through holes 2351, respectively.

A second spacer 238 is assembled between the partition 2341 and the second sealing piece 236, wherein the second spacer 238 is a rubber spacer to avoid the friction between the second sealing piece 236 and the partition 2341. The second spacer 238 has two second spacer through holes 2381, which are in communication with the two second sealing piece through holes 2361, respectively.

In an embodiment, as shown in FIGS. 4-9 and 20, the spray pipe joints 211 comprise a first flushing joint 2111 and a second flushing joint 2112 arranged at an interval.

The water returning channels 222 comprise a first water returning channel 2221 and a second water returning channel 2222 which are independent from each other. The water returning joints 226 comprise a first water returning joint 2261 being in communication with the first water returning channel 2221, and a second water returning joint 2262 being in communication with the second water returning channel 2222.

The water guiding grooves 223 comprise a first diverting groove 2231 and a second diverting groove 2232 arranged at an interval.

The first diverting groove 2231 is in communication with the first water returning channel 2221, and the first flushing joint 2111 is in communication with the first diverting groove 2231.

The second diverting groove 2232 is in communication with the second water returning channel 2222, and the second flushing joint 2112 is in communication with the second diverting groove 2232.

In this embodiment, the spray pipe joints 211 comprise a first flushing joint 2111 and a second flushing joint 2112, which are suitable for the case where the flushing assembly has two spray pipes (for forward and backward flushing), wherein the first flushing joint 2111 and the second flushing joint 2112 are connected with a spray pipe through a water pipe, respectively.

Accordingly, the water returning channels 222 comprise a first water returning channel 2221 and a second water returning channel 2222, which are independent from each other.

Accordingly, the water returning joints 226 comprise a first water returning joint 2261 and a second water returning joint 2262. The first water returning joint 2261 is in communication with the first water returning channel 2221, and the second water returning joint 2262 is in communication with the second water returning channel 2222.

Accordingly, the water guiding grooves 223 comprise a first diverting groove 2231 and a second diverting groove 2232. The first diverting groove 2231 is in communication with the first water returning channel 2221, and the first flushing joint 2111 is in communication with the first diverting groove 2231. The second diverting groove 2232 is in communication with the second water returning channel 2222, and the second flushing joint 2112 is in communication with the second diverting groove 2232.

The switching valve of the spray pipe switching valve 11 can switch the waterways to control the water to return into the first water returning channel 2221 and/or the second water returning channel 2222, and thereby control the water being sprayed from the corresponding spray pipe. For example, when water returns into the first return runner 221, one spray pipe realizes the forward flushing; when water returns into the second water returning channel 2222, the other spray pipe realizes the backward flushing, so as to satisfy different flushing needs for the users.

Figure 10:
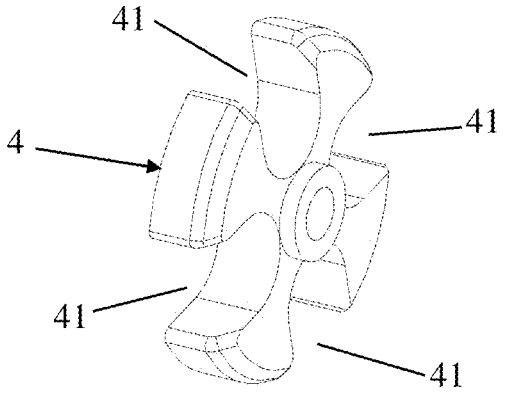
FIG. 10 is a perspective view of a chuck.
Figure 21:
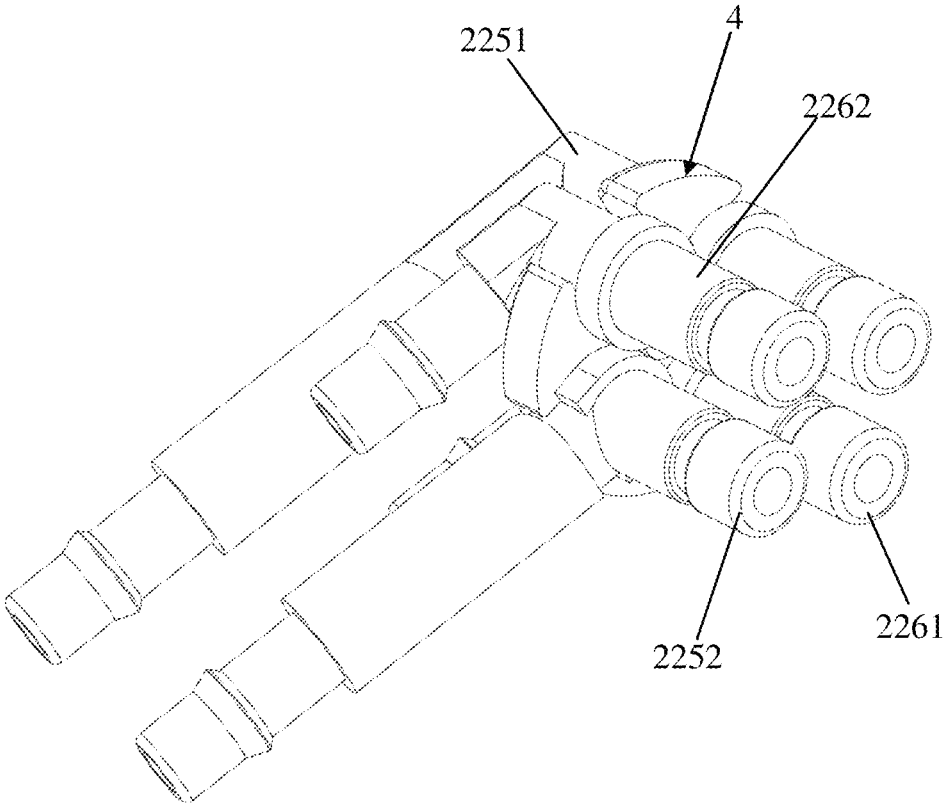
FIG. 21 is a schematic diagram of the water supply joints and the water returning joints fixed by a chuck.
Figure 24:
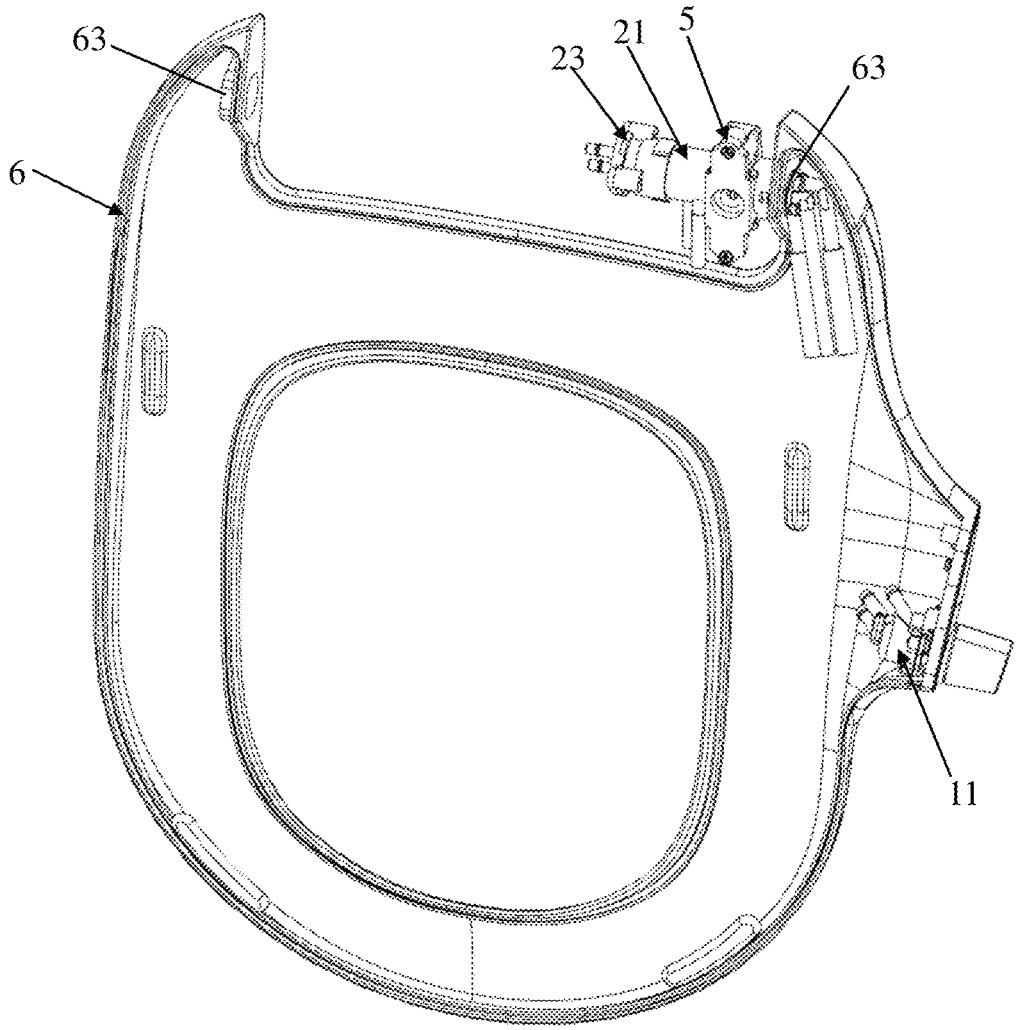
FIG. 24 is a schematic diagram of a seat mechanism provided by an embodiment of the present disclosure.

In an embodiment, as shown in FIGS. 21, 10, and 24, the waterway diverting structure comprises a chuck 4 for being assembled with the pivot sleeves 63 of a seat 6. More than two slots 41 are provided on the chuck 4 at intervals. The water supply joints 225 and the water returning joints 226 are clamped in the slots 41, respectively.

In this embodiment, one end of the rotating valve core 22 is configured with the chuck 4, which may be connected with the rotating valve core 22, or may be arranged at an interval from the rotating valve core 22. The chuck 4 is used to be clamped with a connecting sleeve (e.g., a pivot sleeve 63) of a rear end of the seat 6. The center of the pivot sleeves 63 is the pivot shaft or the pivot center of the seat 6. Thus, the chuck 4 can be rotated with the seat 6 as a whole. The chuck 4 is provided with more than two slots 41 along the circumferential direction, and the water supply joints 225 and the water returning joints 226 are clamped in the slots 41, respectively. When rotating, the chuck 4 drives the water supply joints 225 and the water returning joints 226 to rotate with it as whole, which in turn drives the rotating valve core 22 to rotate with them as a whole. The arrangements of the water pipes connected between the spray pipe switching valve 11 and the water supply joints 225 and the water pipes connected between the spray pipe switching valve 11 and the water returning joints 226 will not be affected.

Figure 23:
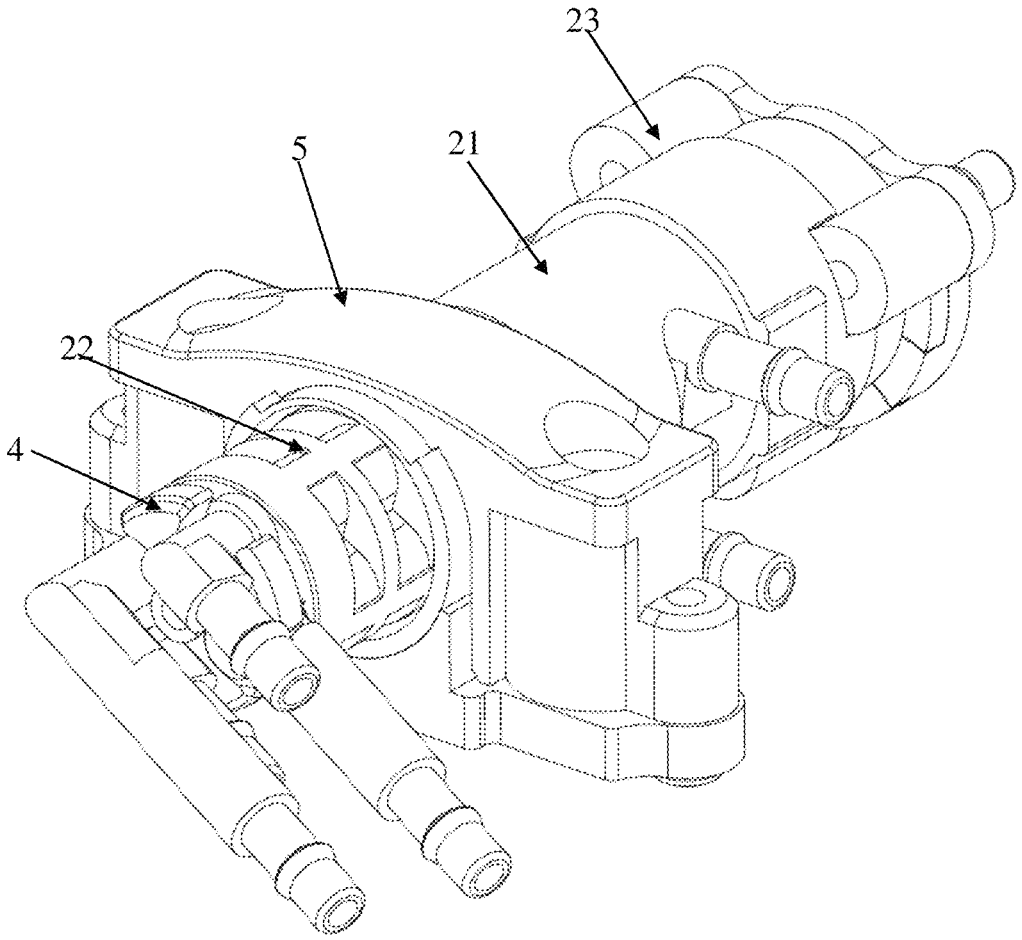
FIG. 23 is a perspective view of a water diverting structure provided by another embodiment of the present disclosure.

In an embodiment, as shown in FIG. 23, the waterway diverting structure comprises a connecting base 5 for being connected with a mounting base of a seat 6, wherein the connecting base 5 is connected with the diverting valve housing 21, so as to secure the waterway diverting structure in a rear base at the rear end of the seat 6.

As shown in FIG. 24, a seat mechanism provided by an embodiment of the present disclosure comprises a seat 6 and a waterway diverting structure according to any one of the preceding embodiments.

The diverting valve housing 21 is connected with the seat 6.

A rear end of the seat 6 has the pivot sleeves 63, wherein the rotating valve core 22 is arranged coaxially with the pivot sleeves 63 and rotates with the seat 6 as a whole.

A seat mechanism provided by the present disclosure comprises a seat 6 and a waterway diverting structure.

With respect to the structure, the construction and the working principle of the waterway diverting structure, please refer to the previous description section of the waterway diverting structure, which will not be repeated herein.

The diverting valve housing 21 is fixedly mounted in a rear base at the rear end of the seat 6, wherein the rotating valve core 22 is arranged coaxially with the pivot sleeves 63, and the water supply joints 225 and the water returning joints 226 pass through the pivot sleeves 63 and are connected with the spray pipe switching valve 11 through the water pipes. When the seat 6 is rotating, the rotating valve core 22 rotates with the seat 6 as a whole.

With respect to the flushing assembly in the seat 6 (for example, a spray pipe), please refer to the prior art, which will not be repeated herein.

With respect to the spray pipe switching valve 11 (for example, a mixing valve and/or a switching valve), please refer to the prior art, which will not be repeated here.

With respect to the temperature control valve, please refer to the prior art, which will not be repeated here.

The above technical solutions may be combined as required to achieve the best technical effect.

The above are merely the principle and the embodiments of the present disclosure. It should be pointed out that, for those of ordinary skill in the art, other variations may be made on the basis of the principle of the present disclosure, which should also be regarded as falling into the protection scope of the present disclosure.

I claim:

1. A seat waterway system, comprising:

a control mechanism configured to be disposed at one side of a seat, the control mechanism comprising a spray pipe switching valve; and a waterway diverting valve, comprising:

a diverting valve housing configured to be disposed in a rear base of the seat;

a rotating valve core pivotably connected to the diverting valve housing and configured to be rotated with the seat, the rotating valve core comprising one end disposed in the diverting valve housing; and a diverting valve inlet end configured to be connected to one end of the diverting valve housing.

2. The seat waterway system according to claim 1, wherein the diverting valve inlet end comprises an inlet joint, wherein the rotating valve core comprises:

a water supply channel, comprising an inlet in communication with the inlet joint and comprising an outlet in communication with a switching valve inlet of the spray pipe switching valve.

3. The seat waterway system according to claim 2, wherein the rotating valve core comprises a water returning channel, wherein an inlet of the water returning channel is in communication with a switching valve outlet of the spray pipe switching valve, wherein an outer peripheral surface of the rotating valve core comprises a water guiding groove in communication with the water returning channel, and wherein the diverting valve housing comprises a spray pipe joint in communication with the water guiding groove.

4. The seat waterway system according to claim 3, wherein the water guiding groove is in an arcuate or annular shape.

5. The seat waterway system according to claim 3, wherein the diverting valve housing comprises two spray pipe joints, wherein two water guiding grooves are disposed on an outer peripheral surface of the rotating valve core and are spaced apart from each other, wherein the two water guiding grooves are in communication with the two spray pipe joints, respectively, wherein the rotating valve core comprises two water returning channels in communication with the two water guiding grooves, respectively, and wherein the spray pipe switching valve comprises two switching valve outlets in communication with inlets of the two water returning channels, respectively.

6. The seat waterway system according to claim 3, wherein the inlet of the water returning channel and the outlet of the water supply channel are disposed at a same end of the rotating valve core, wherein the outlet of the water supply channel is connected to a water supply joint, and wherein the inlet of the water returning channel is connected to a water returning joint.

7. The seat waterway system according to claim 6, further comprising a chuck configured to be clamped with a pivot sleeve of the seat, wherein a circumferential surface of the chuck comprises a plurality of slots spaced apart from each other, and wherein the water supply joint and the water returning joint are clamped in the slots, respectively.

8. The seat waterway system according to claim 2, wherein the inlet joint comprises a cold water inlet joint and a hot water inlet joint, and wherein the water supply channel comprises:

a cold water supply channel in communication with the cold water inlet joint; and a hot water supply channel in communication with the hot water inlet joint, and wherein the control mechanism further comprises a mixing valve, and the mixing valve comprises:

a cold water inlet in communication with an outlet of the cold water supply channel;

a hot water inlet in communication with an outlet of the hot water supply channel; and a warm water outlet in communication with the switching valve inlet.

9. The seat waterway system according to claim 8, wherein the inlet joint further comprises a temperature control valve, and wherein the hot water inlet joint is in communication with a hot water outlet of the temperature control valve.

10. The seat waterway system according to claim 8, wherein the diverting valve inlet end comprises a fixing sleeve and an end cap connected with the fixing sleeve, wherein the cold water inlet joint and the hot water inlet joint are connected to the end cap, respectively, wherein a rotating sleeve is disposed in the fixing sleeve, and a partition is disposed in the rotating sleeve, wherein a first sealing piece and a second sealing piece attached to the first sealing piece are disposed between the end cap and the rotating sleeve, wherein the first sealing piece comprises two first sealing piece through holes in communication with the cold water inlet joint and the hot water inlet joint, respectively, wherein the second sealing piece comprises two second sealing piece through holes in communication with the two first sealing piece through holes, respectively, wherein the second sealing piece through holes are in an arcuate shape, and wherein an inlet end of the cold water supply channel and an inlet end of the hot water supply channel pass through the partition, respectively, and in communication with the two second sealing piece through holes, respectively.

11. The seat waterway system according to claim 10, wherein the first sealing piece and the second sealing piece are ceramic sealing pieces.

12. The seat waterway system according to claim 10, further comprising:

a first spacer disposed between the end cap and the first sealing piece; and a second spacer disposed between the partition and the second sealing piece, wherein the first spacer comprises two first spacer through holes in communication with the two first sealing piece through holes, respectively, and wherein the second spacer comprises two second spacer through holes in communication with the two second sealing piece through holes, respectively.

13. The seat waterway system according to claim 12, wherein the inlet end of the cold water supply channel is connected to a cold water inlet end plug joint, wherein the inlet end of the hot water supply channel is connected to a hot water inlet end plug joint, wherein the partition comprises two partition through holes configured to allow the cold water inlet end plug joint and the hot water inlet end plug joint to pass through, and wherein the cold water inlet end plug joint and the hot water inlet end plug joint pass through the two partition through holes and are inserted into the two second spacer through holes, respectively.

14. The seat waterway system according to claim 1, wherein the diverting valve housing is connected to a connecting base configured to be connected to the rear base of the seat.

15. A seat structure, comprising:

a seat;

a rear base configured to be connected to a rear end of the seat;

a pivot sleeve configured to be connected to the rear end of the seat and pivotably connected to the rear base;

a flushing spray pipe disposed in the seat and/or the rear base and configured to be extended and retracted; and a seat waterway system, comprising:

a control mechanism configured to be disposed at one side of a seat, the control mechanism comprising a spray pipe switching valve; and a waterway diverting valve, comprising:

a diverting valve housing configured to be disposed in the rear base;

a rotating valve core pivotably connected to the diverting valve housing and configured to be rotated with the seat, the rotating valve core comprising one end disposed in the diverting valve housing; and a diverting valve inlet end configured to be connected to one end of the diverting valve housing.

16. The seat structure according to claim 15, wherein the diverting valve inlet end comprises an inlet joint, wherein the rotating valve core comprises:

a water supply channel, comprising an inlet in communication with the inlet joint and comprising an outlet in communication with a switching valve inlet of the spray pipe switching valve, wherein the control mechanism is disposed at one side of the seat, wherein the waterway diverting valve is disposed in the rear base, wherein the rotating valve core is coaxially arranged with the pivot sleeve and configured to rotate with the pivot sleeve, wherein a switching valve outlet of the spray pipe switching valve is in communication with the flushing spray pipe, and wherein the spray pipe switching valve comprises a mechanical handle extending outwardly from an outer side of the seat.

17. The seat structure according to claim 16, wherein the rotating valve core comprises a water returning channel, wherein an inlet of the water returning channel is in communication with the switching valve outlet of the spray pipe switching valve, wherein an outer peripheral surface of the rotating valve core comprises a water guiding groove in communication with the water returning channel, and wherein the diverting valve housing comprises a spray pipe joint in communication with the water guiding groove and the flushing spray pipe.

18. The seat structure according to claim 17, wherein an inlet of the water returning channel and an outlet of the water supply channel are disposed at a same end of the rotating valve core, wherein the outlet of the water supply channel is connected to a water supply joint, wherein the inlet of the water returning channel is connected to a water returning joint, wherein the seat waterway system further comprises a chuck configured to clamped with the pivot sleeve, wherein a circumferential surface of the chuck comprises a plurality of slots spaced apart from each other, and wherein the water supply joint and the water returning joint are clamped in the slots, respectively.

19. The seat structure according to claim 15, wherein one side of the seat comprises a seat extension portion, and wherein the control mechanism is disposed in the seat extension portion.

20. The seat structure according to claim 19, wherein the control mechanism comprises a trim plate configured to be connected to the spray pipe switching valve, wherein an outer surface of the seat extension portion comprises an extension recess, and wherein the trim plate is disposed in the extension recess.

* * * * *